US008705991B2

(12) United States Patent
Tomita

(10) Patent No.: US 8,705,991 B2
(45) Date of Patent: Apr. 22, 2014

(54) IMAGE FORMING APPARATUS, IMAGE FORMING CONTROL METHOD, AND RECORDING MEDIUM STORING IMAGE FORMING CONTROL PROGRAM

(75) Inventor: Kentaro Tomita, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 176 days.

(21) Appl. No.: 13/342,325

(22) Filed: Jan. 3, 2012

(65) Prior Publication Data

US 2012/0170950 A1 Jul. 5, 2012

(30) Foreign Application Priority Data

Jan. 5, 2011 (JP) ..... 2011-000761
Aug. 5, 2011 (JP) ..... 2011-172206

(51) Int. Cl.
*G03G 15/01* (2006.01)

(52) U.S. Cl.
USPC ..... 399/39

(58) Field of Classification Search
USPC ..... 399/39, 40
See application file for complete search history.

(56) References Cited

U.S. PATENT DOCUMENTS

2005/0094169 A1* 5/2005 Berns et al. ..... 358/1.9
2008/0225342 A1* 9/2008 Lin ..... 358/3.06
2009/0220254 A1* 9/2009 Tenjiku ..... 399/30

FOREIGN PATENT DOCUMENTS

JP 2001-343827 A 12/2001
JP 2005-311644 A 11/2005
JP 2010-271595 A 12/2010

OTHER PUBLICATIONS

Translation of Hirofumi, JP,2010-271595, A. Pub date: Feb. 12, 2010.*

* cited by examiner

*Primary Examiner* — Walter L Lindsay, Jr.
*Assistant Examiner* — Frederick Wenderoth
(74) *Attorney, Agent, or Firm* — Harness, Dickey & Pierce, P.L.C.

(57) ABSTRACT

An image forming apparatus is provided with a measuring device, which measures multi-colors in a multi-color toner image formed on a recording sheet that is output from the image forming apparatus. Based on the measured multi-colors, the image forming apparatus estimates an output value of each one of primary color toner images that constitute the multi-color toner image, and corrects an image forming condition of each one of the primary color toner images based on comparison between the estimated output value of the primary color toner image and a target value of the primary color toner image.

15 Claims, 12 Drawing Sheets

FIG. 14A

FIG.14 FIG.14A FIG.14B

| | |
|---|---|
| EQUATION 1 | $\mathrm{MixedColor}(\lambda) = \mathrm{cyan}(kc, \lambda) \times \mathrm{magenta}(km, \lambda) \times \mathrm{yellow}(ky, \lambda) \times \mathrm{black}(kk, \lambda)$ |
| EQUATION 2 | $\begin{bmatrix} \mathrm{MixedColor}(\lambda_{400}) \\ \mathrm{MixedColor}(\lambda_{410}) \\ \mathrm{MixedColor}(\lambda_{420}) \\ \vdots \\ \mathrm{MixedColor}(\lambda_{690}) \\ \mathrm{MixedColor}(\lambda_{700}) \end{bmatrix} = \begin{bmatrix} \mathrm{cyan}(kc, \lambda_{400}) \\ \mathrm{cyan}(kc, \lambda_{410}) \\ \mathrm{cyan}(kc, \lambda_{420}) \\ \vdots \\ \mathrm{cyan}(kc, \lambda_{690}) \\ \mathrm{cyan}(kc, \lambda_{700}) \end{bmatrix} \times \begin{bmatrix} \mathrm{magenta}(km, \lambda_{400}) \\ \mathrm{magenta}(km, \lambda_{410}) \\ \mathrm{magenta}(km, \lambda_{420}) \\ \vdots \\ \mathrm{magenta}(km, \lambda_{690}) \\ \mathrm{magenta}(km, \lambda_{700}) \end{bmatrix} \times \begin{bmatrix} \mathrm{yellow}(ky, \lambda_{400}) \\ \mathrm{yellow}(ky, \lambda_{410}) \\ \mathrm{yellow}(ky, \lambda_{420}) \\ \vdots \\ \mathrm{yellow}(ky, \lambda_{690}) \\ \mathrm{yellow}(ky, \lambda_{700}) \end{bmatrix} \times \begin{bmatrix} \mathrm{black}(kk, \lambda_{400}) \\ \mathrm{black}(kk, \lambda_{410}) \\ \mathrm{black}(kk, \lambda_{420}) \\ \vdots \\ \mathrm{black}(kk, \lambda_{690}) \\ \mathrm{black}(kk, \lambda_{700}) \end{bmatrix}$ |
| EQUATION 3 | $J = \lVert \mathrm{MixedColor}(\lambda) - \mathrm{cyan}(kc, \lambda) \times \mathrm{magenta}(km, \lambda) \times \mathrm{yellow}(ky, \lambda) \times \mathrm{black}(kk, \lambda) \rVert$ |
| EQUATION 4 | $J^2 = \{\mathrm{MixedColor}(\lambda_{400}) - \mathrm{cyan}(kc, \lambda_{400}) \times \mathrm{magenta}(km, \lambda_{400}) \times \mathrm{yellow}(ky, \lambda_{400}) \times \mathrm{black}(kk, \lambda_{400})\}^2$<br>$+ \{\mathrm{MixedColor}(\lambda_{410}) - \mathrm{cyan}(kc, \lambda_{410}) \times \mathrm{magenta}(km, \lambda_{410}) \times \mathrm{yellow}(ky, \lambda_{410}) \times \mathrm{black}(kk, \lambda_{410})\}^2$<br>$+ \{\mathrm{MixedColor}(\lambda_{420}) - \mathrm{cyan}(kc, \lambda_{420}) \times \mathrm{magenta}(km, \lambda_{420}) \times \mathrm{yellow}(ky, \lambda_{420}) \times \mathrm{black}(kk, \lambda_{420})\}^2$<br>$+ \cdots$<br>$+ \{\mathrm{MixedColor}(\lambda_{690}) - \mathrm{cyan}(kc, \lambda_{690}) \times \mathrm{magenta}(km, \lambda_{690}) \times \mathrm{yellow}(ky, \lambda_{690}) \times \mathrm{black}(kk, \lambda_{690})\}^2$<br>$+ \{\mathrm{MixedColor}(\lambda_{700}) - \mathrm{cyan}(kc, \lambda_{700}) \times \mathrm{magenta}(km, \lambda_{700}) \times \mathrm{yellow}(ky, \lambda_{700}) \times \mathrm{black}(kk, \lambda_{700})\}^2$ |

FIG. 14B

| | |
|---|---|
| EQUATION 5 | $\mathrm{red}(0.5, \lambda) = \mathrm{magenta}(0.5, \lambda) \times \mathrm{yellow}(0.5, \lambda)$ |
| EQUATION 6 | $(km,ky) = \begin{bmatrix} (0.4,0.4) & (0.4,0.5) & (0.4,0.6) \\ (0.5,0.4) & (0.5,0.5) & (0.5,0.6) \\ (0.6,0.4) & (0.6,0.5) & (0.6,0.6) \end{bmatrix}$ |
| EQUATION 7 | $\mathrm{cyan}(k'_c, \lambda) = \dfrac{(k_{c(n+1)} - k_c') \times \mathrm{cyan}(k_{cn}, \lambda) + (k_c' - k_{cn}) \times \mathrm{cyan}(k_{c(n+1)}, \lambda)}{k_{c(n+1)} - k_{cn}}$ |

IMAGE FORMING APPARATUS, IMAGE FORMING CONTROL METHOD, AND RECORDING MEDIUM STORING IMAGE FORMING CONTROL PROGRAM

CROSS-REFERENCE TO RELATED APPLICATIONS

This patent application is based on and claims priority pursuant to 35 U.S.C. §119 to Japanese Patent Application Nos. 2011-000761, filed on Jan. 5, 2011, and 2011-172206, filed on Aug. 5, 2011, in the Japan Patent Office, the entire disclosure of which is hereby incorporated herein by reference.

BACKGROUND

1. Field

The present invention generally relates to an image forming apparatus such as a copier, facsimile, and printer, capable of improving color stability of an image, and more specifically, to an image forming apparatus capable of improving color stability of an image by correcting image forming conditions of the image forming apparatus based on information obtained by measuring colors of a toner image output from the image forming apparatus, a method of controlling the image forming apparatus, and a recording medium storing an image forming control program.

2. Background

In image forming apparatuses that form a toner image using electrophotographic method, if an amount of charge on toner in a developer in a developing device is not stable, the developing density may fluctuate, thus causing colors in the toner image to be unstable. Since the amount of toner in the developer decreases as toner is used for the developing process, toner is constantly supplied to the developer to keep a toner density in the developer to be within a predetermined range. While the amount of charge on the toner in the developer gradually increases as the toner is agitated with carrier particles in the developer, the amount of charge on the toner, which is expressed as a charge-to-mass ratio "Q/M", may not be sufficiently high enough especially when images requiring a large amount of toner are successively printed. This causes more toner particles to be adhered to the latent image, thus increasing the developing density. On the other hand, in case of sequentially printing images requiring less toner, the amount of charge on the toner, which is expressed as Q/M, increases such that the developing density decreases.

Japanese Patent Application Publication No. 2001-343827 describes an image forming apparatus, which forms a test toner image on a latent image carrier and detects a toner adhesion amount per unit area of the test toner image. The amount of toner to be supplied to the developer is determined based on the detected toner adhesion amount, thus keeping the charge amount of toner to be within the predetermined range. With this toner adhesion amount stabilization process, the fluctuations in developing density are suppressed such that colors of the toner image are stabilized.

The above-described toner adhesion stabilization process has drawbacks such that it requires printing of test toner images in addition to printing of images ("user images") requested by a user, thus increasing the overall printing costs and lowering productivity in printing the user images. Further, the user is required to sort the test toner images from the user images after being printed.

Japanese Patent Application Publication No. 2010-271595 discloses an image forming apparatus that measures colors of the user image formed on the recording sheet, and corrects image forming conditions to stabilize the toner adhesion amount based on the measured colors such that printing of the test toner image is not necessary. However, since the colors obtained from the user image are multi-colors, controlling the image forming conditions of each one of primary color images based on the measured multi-colors has been difficult. More specifically, colors used by the image forming apparatuses are mainly classified into primary colors and multi-colors. The primary colors are reproduced using only one type of toner. If there are four types of toner including yellow toner, magenta toner, cyan toner, and black toner, any one of the colors that can be reproduced using one type of toner is referred to as the primary color. The multi-colors are reproduced using more than one type of toner, such as by superimposing toner images of different primary colors one above the other. Since the developing density of each of the primary colors that constitute the multi-colors in the user image cannot be obtained directly from the measured multi-colors in the user image, correcting the image forming conditions of the primary color images based on the measured multi-colors in the user image has been difficult.

SUMMARY

In view of the above, the inventor of the present invention has realized that there is a need for an image forming apparatus capable of stabilizing colors of a toner image by correcting image forming conditions of each one of primary color images, based on the measured multi-colors of the toner image that is output from the image forming apparatus.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIGS. 14A to 14B are a list of equations illustrating calculation performed by a main controller of FIG. 8 in color stabilization process, according to an example embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Figure 1:
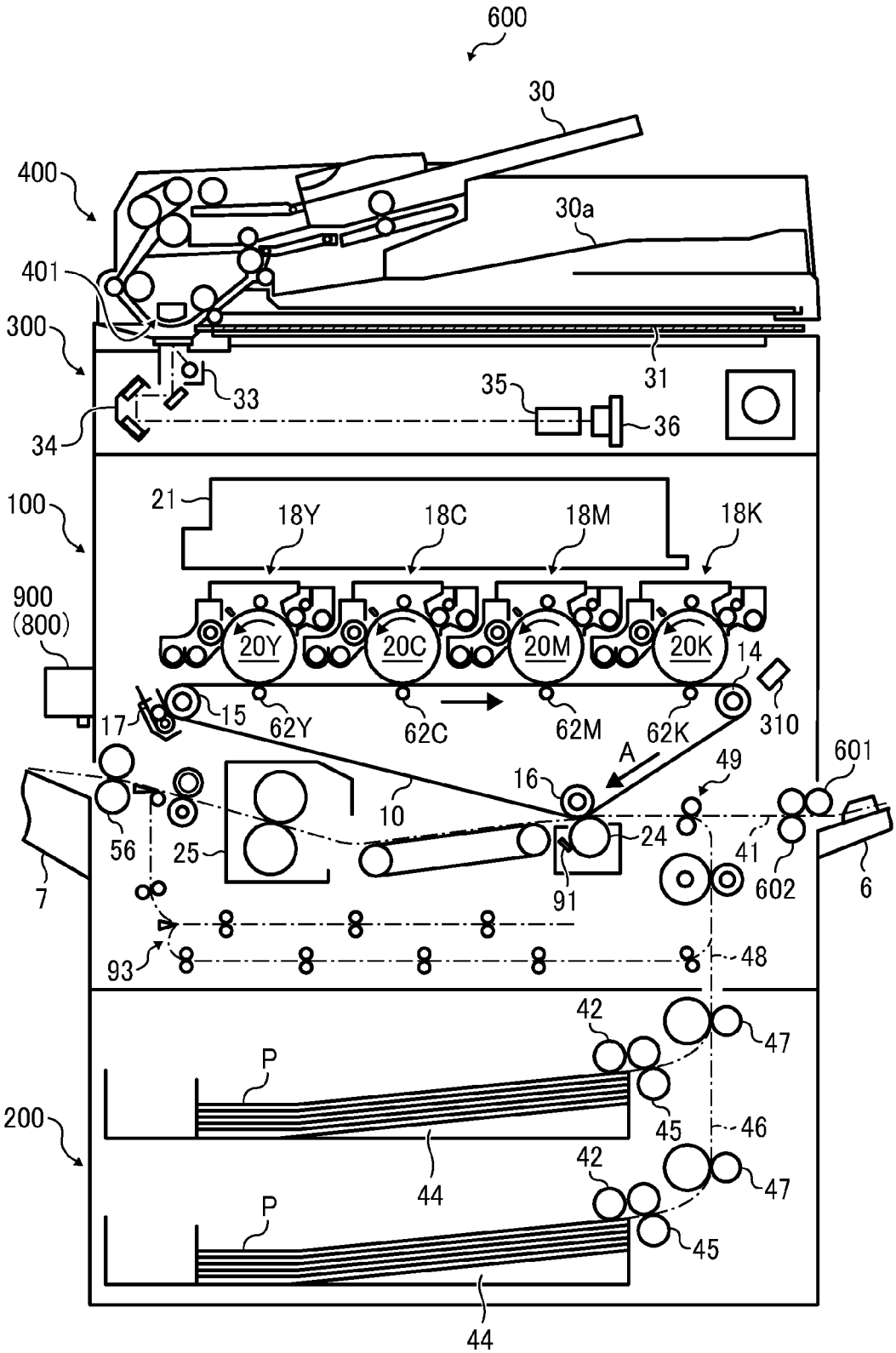
FIG. 1 is a schematic block diagram illustrating a copier according to an example embodiment of the present invention.

Referring to FIG. 1, a structure of an image forming apparatus is explained according to an example embodiment of the present invention. In this example, the image forming apparatus is implemented by a copier 600. The copier 600 includes a printer 100 that forms an image on a recording sheet P, a sheet feeding device 200 that supplies the recording sheet P to the printer 100, a scanner 300 mounted on the printer 100, and an automatic document feeder (ADF) 400 mounted on the scanner 300. The printer 100 is provided with a manual sheet feed tray 6 and a sheet discharge tray 7. The manual sheet feed tray 6 receives a recording sheet P manually fed by a user, which is to be transferred to the inside of the printer 100. The printed sheet P having the toner image formed thereon is discharged from the printer 100 onto the sheet discharge tray 7.

In copying operation, a set of original documents to be copied are placed onto a document tray 30 of the ADF 400. If the original documents are bound together, the original documents are placed on an exposure glass 31 of the scanner 300. When the ADF 400 is opened with respect to the exposure glass 31, the exposure glass 31 is exposed to the user. The user may place the original documents thereon while making a page to be copied to be faced downward, and closes the ADF 400 such that the original documents are placed against the exposure glass 31.

In case the original documents are placed on the exposure glass 31, as the user presses a start key of the copier 600, the scanner 300 drives a first scanner body 33 such that a light beam irradiated from a light source of the first scanner body 33 is scanned through a document surface via the exposure glass 31. The light beam is reflected by the document surface to generate a reflective light.

In case the original documents are placed on the ADF 400, as the user presses the start key of the copier 600, the ADF 400 automatically conveys the documents, one sheet by one sheet, to an image reader section 401 that is provided at left sides of the exposure glass 31. The document sheet is conveyed to a document discharge tray 30*a* after the document sheet passes the image reader section 401 where an image on the document sheet is read. The scanner 300 keeps the first scanner body 33 at a position below the image reader section 401. The light beam irradiated from the first scanning body 33 is thus reflected by the document surface of the document sheet as the document sheet passes the image reading section 401.

The scanner 300 further includes a second scanner body 34 having a mirror that deflects the reflective light received from the document surface toward a reading sensor 36 through an imaging lens 35. The reading sensor 36 forms thereon an optical image, which is sent to the printer 100 after being converted to image data. The printer 100 forms an image on the recording sheet P based on the image data read by the scanner 300.

In alternative to forming an image based on the scanned image data, the printer 100 may form an image on a recording sheet based on image data that is received from an external apparatus such as a personal computer.

The sheet feeding device 200 includes a plurality of sheet cassettes 44, a plurality of sheet feed rollers 42, a plurality of pairs of separating rollers 45, and a plurality of pair of transfer rollers 47. The sheet cassette 44 stores therein a stack of recording sheets P. With the sheet feed roller 44 and the separating roller pair 45, the recording sheet P that is placed at the top of stack is fed from the sheet cassette 44 toward a sheet feed path 46. The sheet transfer rollers 47 transfer the recording sheet P along the sheet feed path 46 to a sheet conveying path 48. More specifically, when the user presses the start key or when the copier 600 receives an instruction for printing image data from the external apparatus, the sheet feed roller 42 of selected one of the sheet cassettes 44 rotates to feed the recording sheet P from the sheet cassette 44. Selection of the cassette 44 may be made according to a user instruction. The recording sheet P, which is separated by the separating roller pair 45 from the rest of the recording sheets, is fed to the sheet feed path 46. The recording sheet P is further transferred by the transfer rollers 47 to the sheet conveying path 48 in the printer 100.

Figure 2:
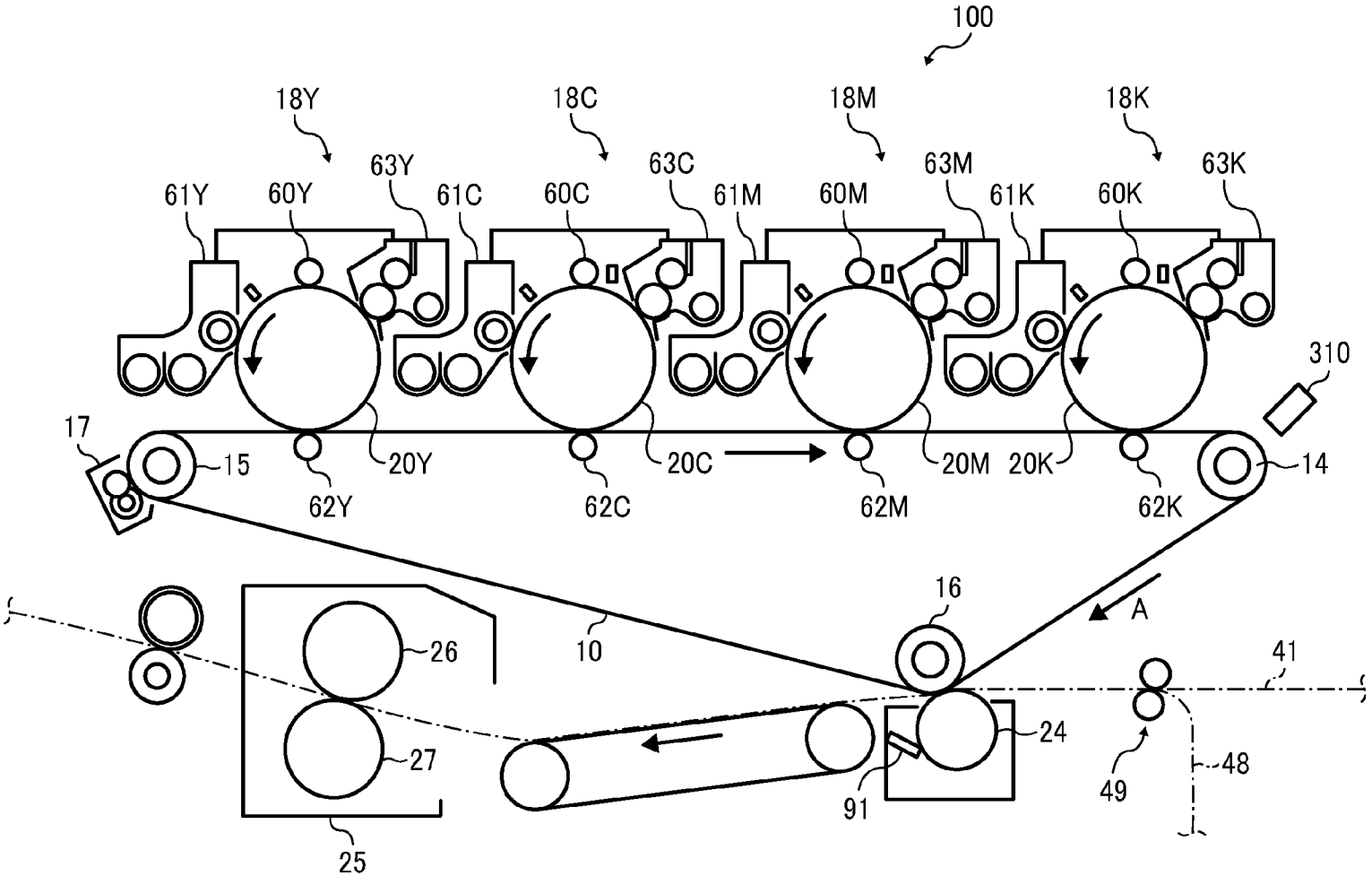
FIG. 2 is a schematic block diagram illustrating an enlarged view of a selected portion of a printer of the copier of FIG. 1.

FIG. 2 is an enlarged view illustrating a selected portion of the printer 100 of FIG. 1. The printer 100 includes an intermediate transfer body, such as an intermediate transfer belt 10. The intermediate transfer belt 10, which is an endless belt, is made of any material that is high in mechanical strength such that the misregistration that may be caused due to stretching of the belt is suppressed. For example, polyimide (PI) may be used as a base substrate of the intermediate transfer belt 10. Further, in order to keep sufficient transferability of an image formed on the belt surface irrespective of the outside environments such as humidity and temperature, carbon, which functions as a resistant adjusting agent, is dispersed over the surface of the base substrate of the intermediate transfer belt 10. For this reasons, the surface of the intermediate transfer belt 10 has a black color. Alternatively, to reduce manufacturing costs, the intermediate transfer belt 10 may be made of polyvinylidence fluoride (PVDF), without carbon being dispersed over the belt surface.

The printer 100 further includes a plurality of rollers such as a first support roller 14, a second support roller 15, and a third support roller 16. The intermediate transfer belt 10 is wound around these rollers so as to be stretched to form a loop having an inversed triangle shape when viewed from the side. The loop made by the intermediate transfer belt 10 has a horizontally stretched surface. When at least one of the support rollers 14, 15, and 16 is rotated, the intermediate transfer belt 10 moves in a counterclockwise direction as indicated by the arrow A in FIGS. 1 and 2.

Above the intermediate transfer belt 10, four image forming units 18Y, 18C, 18M, and 18K are disposed, side by side, along the horizontally stretched surface of the intermediate transfer belt 10. The image forming units 18Y, 18C, 18M, and 18K respectively form toner images of yellow (Y), cyan (C), magenta (M), and black (K) colors. Above these image forming units 18, a latent-image writing unit 21 is provided (FIG. 1). The latent-image writing unit 21 receives image data of the original document that is read by the scanner 300, or image data transmitted from the external apparatus, under control of a writing controller provided in the latent-image writing unit 21. Based on the image data, the latent-image writing unit 21 drives semiconductor laser sources respectively provided for Y, C, M, and K, to irradiate and scan the laser beams for writing the Y image, C image, M image, and K image, toward the respective surfaces of photoconductors 20Y, 20C, 20M, and 20K of the image forming units 18Y, 18C, 18M, and 18K, thus forming latent images of Y, C, M, and K onto the surfaces of the photoconductors 20Y, 20C, 20M, and 20K. In alternative to using the semiconductor laser sources, any desired light source such as LED may be used.

Figure 3:
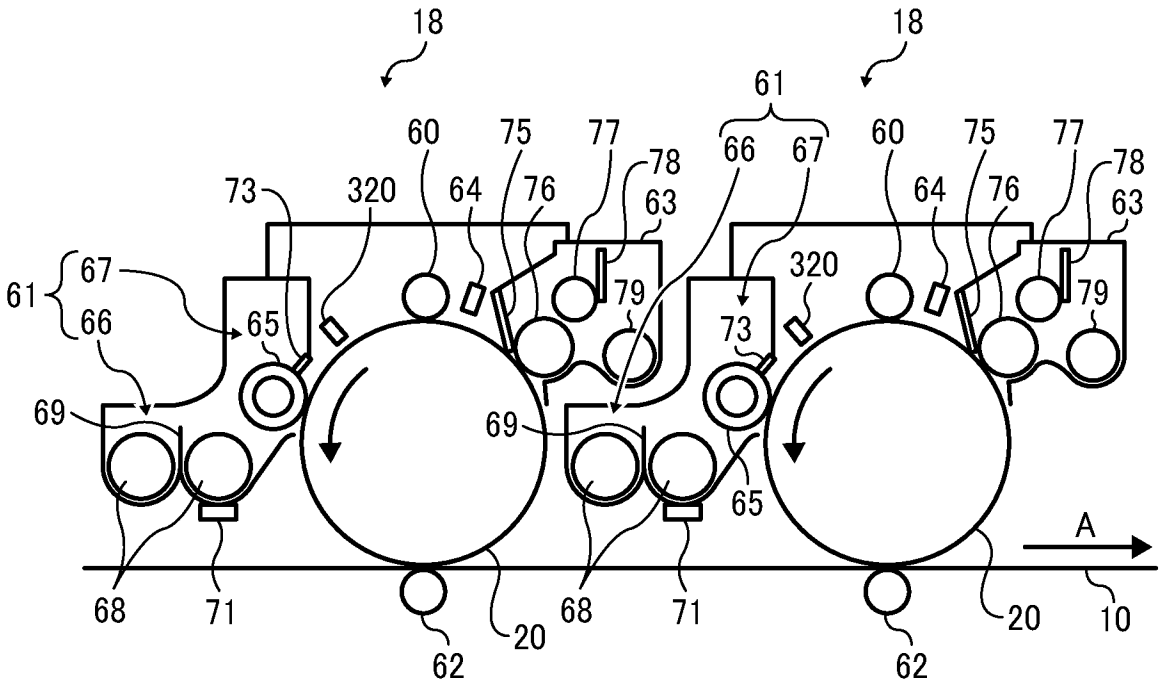
FIG. 3 is a schematic block diagram illustrating an enlarged view of two image forming units of the printer of FIG. 2.

FIG. 3 is an enlarged view illustrating the image forming units 18 that are adjacent with each other, which are selected from the image forming units 18 of the printer 100 shown in FIG. 2. For simplicity, in FIG. 2, the references Y, M, C, and K are omitted. As illustrated in FIG. 3, the image forming unit 18 includes a charging device 60, a developing device 61, a cleaning device 63, and a discharging device 64, which are arranged in the circumferential direction of the photoconductor 20 of drum-like shape.

The charging device 60 charges the surface of the photoconductor 20, which is rotated in the counterclockwise direction, with the same polarity as a charging polarity of toner. In this example illustrated in FIG. 3, the charging device 60 is implemented by a charging roller of non-contact type, which is disposed at a position close to the surface of the photoconductor 20. The charging device 60 is applied with a charging bias to generate electrical discharge between the photoconductor 20 and the charging device 60. With this electrical discharge, the surface of the photoconductor 20 is uniformly charged. In alternative to the charging roller, a scorotron charger of non-contact type may be used as the charging device 60.

Figure 4:
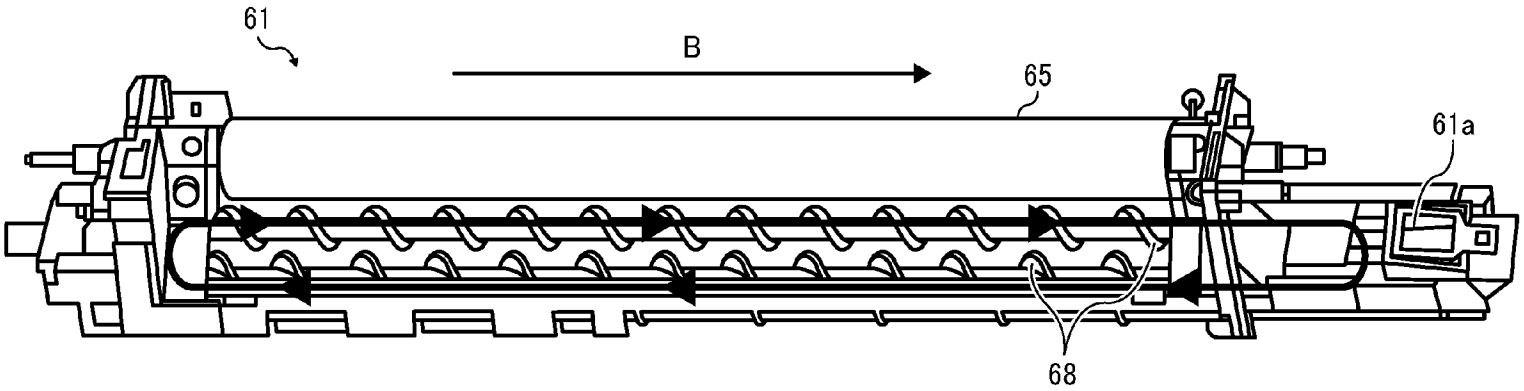
FIG. 4 is a view illustrating a section of the image forming unit of FIG. 3, viewed from the top.

FIG. 4 illustrates the inside of the developing device 61, viewed from the top when the upper part of a casing of the developing device 61 is removed. The developing device 61 develops the latent image formed on the photoconductor 20 into toner image, using a developing agent, i.e., developer, including magnetic carriers and non-magnetic toner. Referring to FIG. 3, the developing device 61 is mainly classified into an agitator section 66 and a developer section 67. The agitator section 66 is provided with two conveying screws 68 that are arranged in parallel with each other. These two conveying screws 68 are separated by a separating wall 69 such that the conveying screws 68 are placed in different rooms. The separating wall 69 includes notches at its both ends along the longitudinal direction of the screws 68. Through the notches, these two rooms each storing the conveying screw 68 therein are communicated. Of these two rooms, the room that is adjacent with the developer section 67 is a feed chamber. The developer in the feed chamber is applied to a developing sleeve 65 in the developer section 67. The other room is a return chamber. The developer fed from the feed chamber returns to the return chamber at one end in the longitudinal direction of the screws 68. The developer is then supplied from the return chamber to the feed chamber at the other end in the longitudinal direction of the screws 68. The conveying screw 68 in the feed chamber and the conveying screw 68 in the return chamber are rotated so as to convey the developer in the opposing directions such that the developer conveyed near the end of the screws 68 in the longitudinal direction is further conveyed into the other chamber through the notches. As indicated by the arrow B in FIG. 4, the developer in the developing device 61 is circulated between the feed chamber and the return chamber. As illustrated in FIG. 3, the agitator section 66 includes a toner density sensor 71 at a bottom surface of the feed chamber, which detects toner density of the developer. As illustrated in FIG. 4, the notches, which allow the lower ends in the conveying direction in the feed chamber and the upper ends in the conveying direction in the return chamber to be communicated, are formed with a toner supply port 61*a*.

The developer section 67 houses therein the developing sleeve 65 made of a rotatable, nonmagnetic pipe. A magnet roller having a plurality of circumferentially-arranged magnetic poles is provided in the developing sleeve 65 and fixed there in a manner such that the magnet roller is not rotated even when the developing sleeve 65 rotates. In the feed chamber of the agitator section 66, the developer is conveyed in a direction indicated by the arrow B in FIG. 4 as the conveying screw 68 rotates. The toner density sensor 71 detects the toner density of the developer being conveyed. A part of the developer is lifted up toward the developing sleeve 65 by a magnetic force exerted by the magnet roller in the developing sleeve 65. The developer lifted up toward the surface of the developing sleeve 65 is transferred by rotation of the developing sleeve 65 to a developing area where the developing sleeve 65 and the photoconductor 20 face with each other. On the way to the developing area, a doctor blade 73 regulates a thickness of the developer formed on the developing sleeve 65. In the developing area, a development potential causes toner particles in the developer to be separated from the magnetic carriers in the developer, and transferred onto a latent image formed on the photoconductor 20. The development potential is a voltage difference between the developing sleeve 65, onto which the developing bias voltage of the same polarity as the polarity of the charge on the toner is applied, and the latent image formed on the surface of the photoconductor 20. The electrostatic latent image on the photoconductor 20 is thus developed into toner image.

When the developer that has passed through the developing area is further conveyed by rotation of the developing sleeve 65 to a position of a repulsive magnet pole in the magnet roller, the developer is released from the surface of the developing sleeve 65 and returned into the feed chamber in the agitator section 66. In the feed chamber, as the developer used in developing is returned to the feed chamber, the toner density in the developer decreases. This decrease in toner density is detected by the toner density sensor 71. Based on this detection result, an appropriate amount of toner is supplied from the toner supply port 61*a* into the feed chamber. The toner supply control based on the detection result of the toner density sensor 71 is performed each time as one sheet is fed.

Referring back to FIG. 2, four primary transfer rollers 62Y, 62C, 62M, and 62K are arranged inside the loop of the intermediate transfer belt 10 so as to face the four photoconductors 20 via the intermediate transfer belt 10. For each of the image forming units 18, the primary transfer roller 62 presses an outer surface of the intermediate transfer belt 10 against the photoconductor 20, thereby forming a primary transfer nip where the outer surface of the belt and the photoconductor 20 are in contact with each other. A primary transfer bias having a polarity opposite of the toner charging polarity is applied onto the primary transfer roller 62, thus forming a primary transfer electric field at the primary transfer nip. This causes toner to be transferred from the photoconductor 20 toward the primary transfer roller 62 such that the toner image formed on the surface of the photoconductor 20 is primary-transferred onto the outer surface of the intermediate transfer belt 10. In alternative to the primary transfer roller 62, any desired primary transfer unit for transferring a toner image on the photoconductor 20 onto the outer surface of the intermediate transfer belt 10 may be used, for example, a transfer brush, or a non-contact corona charger.

Transfer-residual toner, which is not primary-transferred onto the intermediate transfer belt 10, remains deposited on the surface of the photoconductor 20 that has passed through the primary transfer nip. The cleaning device 63 removes this transfer-residual toner from the surface of the photoconductor 20. As illustrated in FIG. 3, the cleaning device 63 supports a cleaning blade 75 made of a polyurethane rubber at one end of the cleaning blade 75. The cleaning device 63 scrapes off the transfer-residual toner from the surface of the photoconductor 20 by bringing the other, free end of the cleaning blade 75 into contact with the surface. A conductive fur brush 76 that rotates while being in contact with the surface of the photoconductor 20 also removes the transfer-residual toner from the surface of the photoconductor 20. The toner removed from the surface of the photoconductor 20 by the cleaning blade 75 and the fur brush 76 is stored in the cleaning device 63 at least temporarily.

The surface of the photoconductor 20, from which the transfer-residual toner has been removed by the cleaning device 63, is illuminated by the discharging device 64 to eliminate the electrostatic charge on the surface. This places the surface potential of the photoconductor 20 in an initial state. After the surface of the photoconductor 20 is uniformly charged by the charging device 60 in the same polarity as the toner charging polarity, a potential sensor 320 detects the surface potential.

In this example, the photoconductor 20 is made of a drum-like shape that is 60 mm in diameter. The photoconductor 20 is rotated counterclockwise in FIG. 3 at a linear velocity of 282 mm/sec. The developing sleeve 65 is made of a columnar shape that is 25 mm in diameter, and is rotated at a linear velocity of 564 mm/sec. An amount of charge on the toner in the developer in the developing device 61 to be supplied to the developing area is approximately in a range between −10 and −30 μC/g. A thickness of a photosensitive layer on the photoconductor 20 is 30 μm; the beam spot diameter and a power of a laser beam emitted from an optical system of the latent-image writing unit 21 is 50×60 μm and approximately 0.47 mW, respectively. The surface of the photoconductor 20 is uniformly charged by the charging device 60 to, for instance, −700 V; the electrostatic potential at a portion of an electrostatic latent image irradiated with the laser beam emitted from the latent-image writing unit 21 becomes −120 V. The developing bias voltage applied to the developing sleeve 65 is −470 V. Accordingly, a developing potential of −350 V is applied on the toner on the electrostatic latent image on the photoconductor 20.

In the image forming unit 18 having the structure as discussed above, the photoconductor 20 is uniformly charged by the charging device 60 while being rotated, and optically scanned by the latent-image writing unit 21, thus forming an electrostatic latent image on the photoconductor 20. This optical scanning is performed based on image data read by the scanner 300 or image data transmitted from the external apparatus. The electrostatic latent image formed on the photoconductor 20 is developed by the developing device 61 into a toner image. The toner image is primary-transferred onto the intermediate transfer belt 10 by the primary transfer electrical field, which is formed between the photoconductor 20 and the primary transfer roller 62. Transfer-residual toner that resides on the surface of the photoconductor 20 is removed by the cleaning device 63. The surface of the photoconductor 20 undergoes electrostatic discharging performed by the discharging device 64 to become ready for a subsequent image forming process.

As illustrated in FIG. 2, the printer 100 further includes a secondary transfer roller 24, which is provided outside the loop of the intermediate transfer belt 10. The intermediate transfer belt 10 is pinched between the secondary transfer roller 24 and the third support roller 16, which is inside the belt loop. The third support roller 16 presses the intermediate transfer belt 10 against the secondary transfer roller 24, thereby forming a secondary transfer nip where the outer surface of the belt and the secondary transfer roller 24 are in contact with each other.

When the start key is pressed by a user, a drive motor is driven to rotate one of the support rollers 14, 15, and 16, which in turn rotates the intermediate transfer belt 10. Concurrently, the photoconductor 20Y, 20C, 20M, and 20K of the image forming units 18Y, 18C, 18M, and 18K are rotated. The latent-image writing unit 21 emits image writing lights to the photoconductors 20Y, 20C, 20M, and 20K of the image forming units 18Y, 18C, 18M, and 18K based on the image data read with the reading sensor 36 of the scanner 300 or the image data received from the external apparatus. As a result, an electrostatic latent image is formed on each of the photoconductors 20Y, 20C, 20M, and 20K. The electrostatic latent images are developed by the developing devices 61Y, 61C, 61M, and 61K such that a Y-toner image, a C-toner image, an M-toner image, and a K-toner image are formed on the photoconductors 20Y, 20C, 20M, and 20K. The formed toner images are primary-transferred onto the intermediate transfer belt 10 at primary transfer nips for yellow, cyan, magenta, and black to be superimposed one above the other. Thus, four-color superimposed toner image, in which toner images of respective colors are superimposed one above the other, is formed on the intermediate transfer belt 10. In the following examples, each one of the black, magenta, cyan, and yellow images may be referred to as the primary color image as the image is formed with one type of toner.

The recording sheet P fed out from the sheet feeding device 200 is conveyed into the sheet conveying path 48 in the printer 100, and stopped at a position where the recording sheet P abuts on a pair of registration rollers 49. The pair of registration rollers 49, which receives the recording sheet P on the sheet conveying path 48, feeds out the recording sheet P to the secondary transfer nip at a timing such that the recording sheet P reaches the secondary transfer nip when the four-color superimposed toner image formed on the intermediate transfer belt 10 reaches the secondary transfer nip. With the secondary transfer electrical field formed between the secondary transfer roller 24 and the third support roller 16, the four-color superimposed toner image is transferred onto the recording sheet P, which is conveyed into the secondary transfer nip. The four-color superimposed toner image on the recording sheet P, becomes a full-color toner image, which may be referred to as a multi-color toner image, by cooperating with a white background of the recording sheet P. The recording sheet P is conveyed to a fixing device 25 where the full-color toner image is fixed to the recording sheet P by heat and pressure at a fixing nip formed between a heating roller 26 and a fixing roller 27. As illustrated in FIG. 1, the recording sheet P that has passed through the fixing device 25 is conveyed either to a direction toward a sheet-reversing device 93 and a direction toward a pair of discharging rollers 56, as switched by a flapper. If the recording sheet P is conveyed into the sheet-reversing device 93, the recording sheet P is conveyed to the pair of registration rollers 49, after being reversed, to form a full-color image on the other side of the recording sheet P. If the recording sheet P is conveyed to the pair of discharging rollers 56, the recording sheet P is stacked on the sheet discharge tray 7 that is provided outside the copier 600.

In this example, in alternative to the secondary transfer roller 24, any desired secondary transfer unit for secondary-transferring the four-color superimposed toner image formed on the intermediate transfer belt 10 onto the recording sheet P may be used, for example, a transfer charger. The printer 100 further includes a roller cleaning unit 91, which is made in contact with the secondary transfer roller 24, to clean toner that resides on the secondary transfer roller 24 after secondary transfer of the image.

The printer 100 further includes a belt cleaning device 17, which is provided at a section that wounds around the second support roller 15 in a manner that is made in contact with that section of the belt. The belt cleaning device 17 cleans transfer-residual toner that resides on the surface of the intermediate transfer belt 10, which passes the secondary transfer nip.

The printer 100 further includes a manual sheet feed path 41, which extends from the manual feed tray 6 and merges with the sheet conveying path 48. At an upstream portion of the manual sheet feed path, a sheet feed roller 601 and a separation roller 602 are provided for feeding the recording sheet P placed on the manual feed tray 6 one sheet at a time.

As illustrated in FIG. 1, a line spectrometer 900 (hereinafter, referred to as "spectrometer") is provided above the sheet discharge tray 7. The spectrometer 900 measures colors of a toner image formed on the recording sheet P that is discharged onto the sheet discharge tray 7. More specifically, the spectrometer 900 obtains a distribution of spectral reflectance from the toner image formed on the recording sheet P. Assuming that a length in the main scanning direction of an image forming area that corresponds to a A4 size recording sheet P ranges between 0 mm to 210 mm, the spectrometer 900 detects spectral reflectance at a total of 22 positions in the main scanning direction length, which are each incremented by 10 mm. Further, the spectrometer 900 is able to detect spectral reflectance in the wavelength range between 400 nm and 700 nm, which is incremented by 10 nm into 31 wavelength values. Further, the spectrometer 900 detects spectral reflectance in the sub-scanning direction, that is, the sheet conveying direction, for each position that is incremented by 10 mm. For each of 22 positions in the main scanning direction length at which spectral reflectance is detected, colors of a square-shaped area of 10 mm by 10 mm are measured, such that 22 color measurements are obtained from the printed image. The spectral reflectance distribution of colors in the printed image is an average value of the 22 color measurements obtained from the square-shaped areas.

Figure 5:
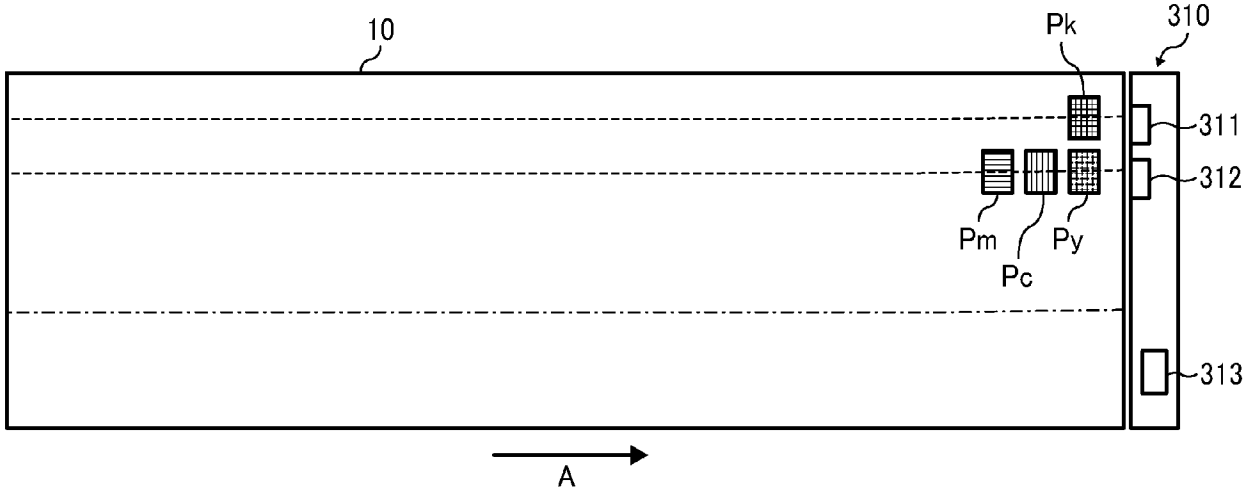
FIG. 5 is a plan view illustrating an intermediate transfer belt and an optical sensor unit in the printer of FIG. 2.

As illustrated in FIGS. 1 and 2, an optical sensor unit 310 is provided outside the loop of the intermediate transfer belt 10 in a manner that the optical sensor unit 310 faces a portion of the intermediate transfer belt 10 supported on the first support roller 14 via a predetermined distance. FIG. 5 illustrates the horizontally stretched surface of the intermediate transfer belt 10 and the optical sensor unit 310, when viewed from the top. As illustrated in FIG. 5, the optical sensor unit 310 includes a first optical sensor 311 for measuring a black toner patch image Pk, and a second optical sensor 312 for measuring a magenta toner patch image Pm, cyan toner patch image Pc, and yellow toner patch image Py, which are arranged along a width direction of the belt. The belt width direction is the direction that is perpendicular to the arrow A in FIG. 5. The second optical sensor 312 is located at a position closer to a center of the belt than the first optical sensor 311 is. This position that is closer to the belt center corresponds to an upstream position in a developer conveyance direction indicated by the arrow B in FIG. 4, along which the conveying screw 68 in the supply chamber conveys the developer to the developing sleeve 65 in the developing area.

Due to the structure of the developing device 61, the toner image developed by the developing device 61 tends to have different values of image density across the toner image surface. More specifically, a portion of the toner image that corresponds to a position that is upstream in the developer conveying direction in the developing area tends to have a higher image density than that of a portion of the toner image that corresponds to a position that is downstream in the developer conveying direction. This is because toner that is relatively low in charging capability tends to be developed upstream in the developer conveying direction, and the height of the developer formed on the developing sleeve 65 tends to be higher in upstream than in downstream. Even the patch images are formed under the same image forming conditions, the adhesion amount of toner on the patch images will be different, depending on its position in the main scanning direction along the developing sleeve 65. The positions of the first optical sensor 311 and the second optical sensor 312 may be each set, while taking into account a specific position in the main scanning direction that needs to be controlled. For the same reasons, the position at which each patch image is formed may be controlled, if only a limited number of patch images are to be formed. For example, when the sensor is positioned upstream in the developer conveying direction in the developing area, the patch images having high image density will be subjected for measurement such that the patch images detected in downstream of the measured area tend to have lower image densities than that of the measured patch images. The upstream position of the sensor is desirable when troubles due to low charging capability of toner are to be controlled, such as scattering of toner within a device of the copier 600 such as the developing device 61. On the other hand, the upstream developer may not be sufficiently agitated such that charging capabilities of toner contained in the upstream developer tend to be large in variance while being unstable. Accordingly, the sensor position should be a position that is sufficiently downstream to obtain measurements that are more reliable from patch images developed with toner having stable charging capability values, but is sufficiently upstream to obtain measurements from patch images with high image density values.

Figure 6:
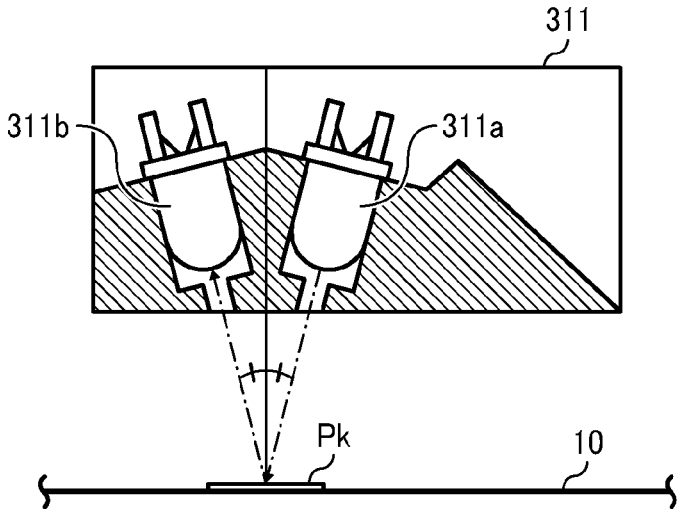
FIG. 6 is a schematic block diagram illustrating a first optical sensor in the optical sensor unit of FIG. 5.
Figure 7:
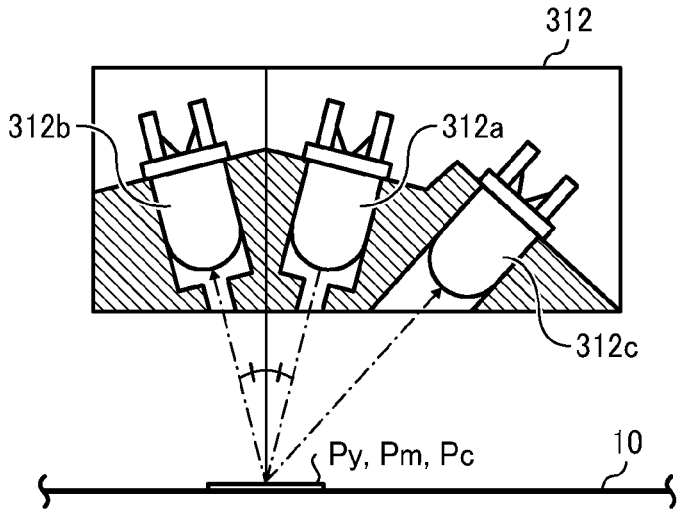
FIG. 7 is a schematic block diagram illustrating a second optical sensor in the optical sensor unit of FIG. 5.

FIG. 6 illustrates an enlarged section of the first optical sensor 311. FIG. 7 illustrates an enlarged section of the second optical sensor 312.

The first optical sensor 311 measures a toner adhesion amount per unit area of the black toner patch image Pk formed on the intermediate transfer belt 10. As illustrated in FIG. 6, the first optical sensor 311 includes a light source (LED) 311*a*, such as a LED, which emits light toward the intermediate transfer belt 10, and a first sensor specular-reflection-light receiving element 311*b* that receives light specularly reflected from the intermediate transfer belt 10. Referring to FIG. 7, the second optical sensor 312 measures a toner adhesion amount per unit area of each of the yellow toner patch image Py, cyan toner patch image Pc, and magenta toner patch image Pm respectively formed on the intermediate transfer belt 10. As illustrated in FIG. 7, the second optical sensor 312 includes a light source 312*a*, such as a LED, which emits light toward the intermediate transfer belt 10, a specular-reflection-light receiving element 312*b* that receives light specularly reflected from the intermediate transfer belt 10, and a diffuse-reflection-light receiving element 312*c* that receives diffuse reflection light from the intermediate transfer belt 10. Each of the light sources 311*a* and 312*a* uses a GaAs infrared-emitting diode whose peak emission wavelength 4 is 950 nm. The receiving elements 311*b*, 312*b*, and 312*c* are each implemented by a light-receiving element, which is a Si phototransistor whose peak receipt wavelength is 800 nm. The optical sensors 311 and 312 are located so as to be away from the intermediate transfer belt 10, which is a measurement target surface, by a distance (detection distance) of 5 mm. The optical sensor unit 310 includes, in addition to the optical sensors, a sensor memory 313 (FIG. 5).

Figure 8:
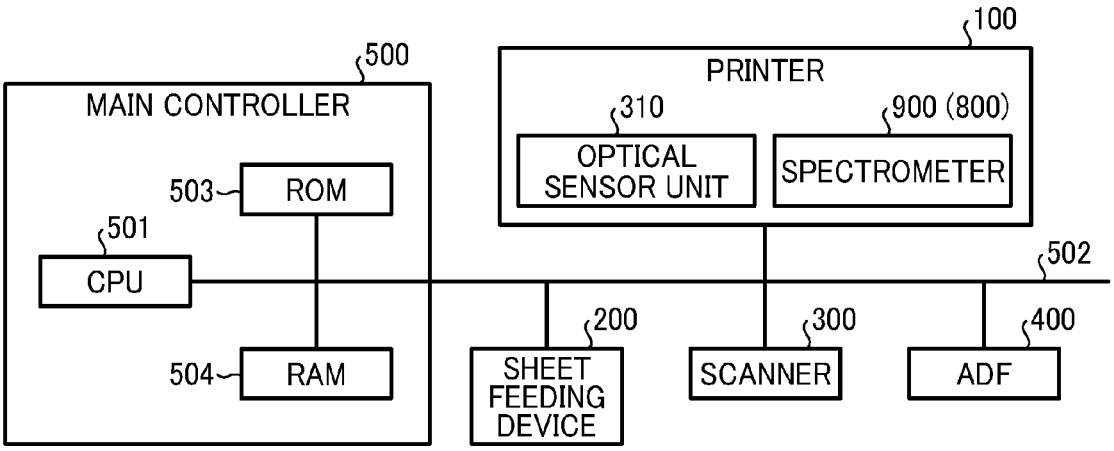
FIG. 8 is a schematic block diagram illustrating electric connections of various units in the copier of FIG. 2.

FIG. 8 is a schematic block diagram illustrating electrical connections of units in the copier 600 that are related to operation of controlling color stability of an image. The copier 600 includes a main controller 500, which controls operation of the units in the copier 600. The main controller 500 includes a central processing unit (CPU) 501 that performs various computations and drive control of the units, a read only memory (ROM) 503 that stores various data such as computer program instructions, and a random access memory (RAM) 504 that stores various data in a rewritable manner to serve as a working area of the CPU 501, which are connected via a bus line 502. The main controller 500 is connected to various units or devices in the printer 100 such as the sheet feeding device 200, the scanner 300, and the ADF 400. The optical sensor unit 310 and the line spectrometer 900 of the printer 100 output measurement results to the main controller 500.

The main controller 500 performs the toner adhesion-amount stabilization process based on the measurement results obtained from the printed image, as an example of color stabilization process. More specifically, the main controller 500 causes a color stabilization control program, which is previously stored in the ROM 503, to be loaded onto the RAM 504 for execution by the CPU 501.

In the prior art, the colors of the multi-color toner image formed on the recording sheet are measured, and compared with the target colors of the multi-color toner image that are previously determined. The image forming conditions of the primary color toner images that constitute the multi-color toner image are corrected such that the measured colors of the multi-color toner image reaches the target colors of the multi-color toner image.

However, obtaining the difference in multi-color has been difficult, as the difference in multi-color cannot be determined based on whether one color is lighter or darker than the other color. While the color difference in the L*a*b* system may be used to determine whether the measured multi-color is close enough to the target multi-color, it would be difficult to determine how the image forming conditions of each primary color can be corrected as they are dependent on various different factors. For this reasons, in order to cause the measured multi-color to be sufficiently close to the target multi-color, information regarding various image forming conditions subjected for correction needs to be previously prepared for each possible set of the measured multi-color and the target multi-color. Such information regarding various image forming conditions subjected for correction is usually obtained through experiments, which has been costly. Further, unless the information regarding various image forming conditions subjected for correction is updated, the accuracy in such information may be lowered. In order to keep the level of accuracy in the information regarding various image forming conditions, a large number of patch images need to be reproduced through experiments such that, during experiments, a large amount of toner will be used while requiring more time for experiments. Thus, correcting image forming conditions based on comparison in multi-color image has been difficult in terms of keeping the accuracy in obtaining correction values for various control parameters of image forming conditions.

In view of the above, in this example, the copier 600 estimates a developing density of each of the primary colors constituting the multi-colors in the multi-color toner image, from the measured multi-colors in the multi-color toner image formed on the recording sheet P. Using this color stabilization process, colors of the output image can be stabilized while greatly reducing the needs for outputting patch images.

In the following examples, the copier 600 causes the spectrometer 900 to obtain information regarding the multi-colors of a multi-color toner image that is printed as a user image, as multi-color information. Based on the obtained multi-color information, the main controller 500 estimates information regarding each of the primary colors Y, M, C, and K that constitute the multi-colors of the multi-color toner image being output, as primary color information. For each of the primary colors Y, M, C, and K, the main controller 500 determines correction values of control parameters that control image forming conditions of the copier 600, based on the difference between the estimated primary color information estimated from the multi-color information of the measurement result, and target primary color information previously obtained. The main controller 500 further corrects the control parameters such as control parameters regarding the image forming unit 18 or the latent-image writing unit 21, using the determined correction values. The control parameters to be corrected include, for example, a target control value of toner density in the developing device 61, a developing bias (Vb), a light intensity (LDP) of the image writing light that is irradiated by the latent-image writing unit 21 onto the surface of the photoconductor 20.

Figure 9:
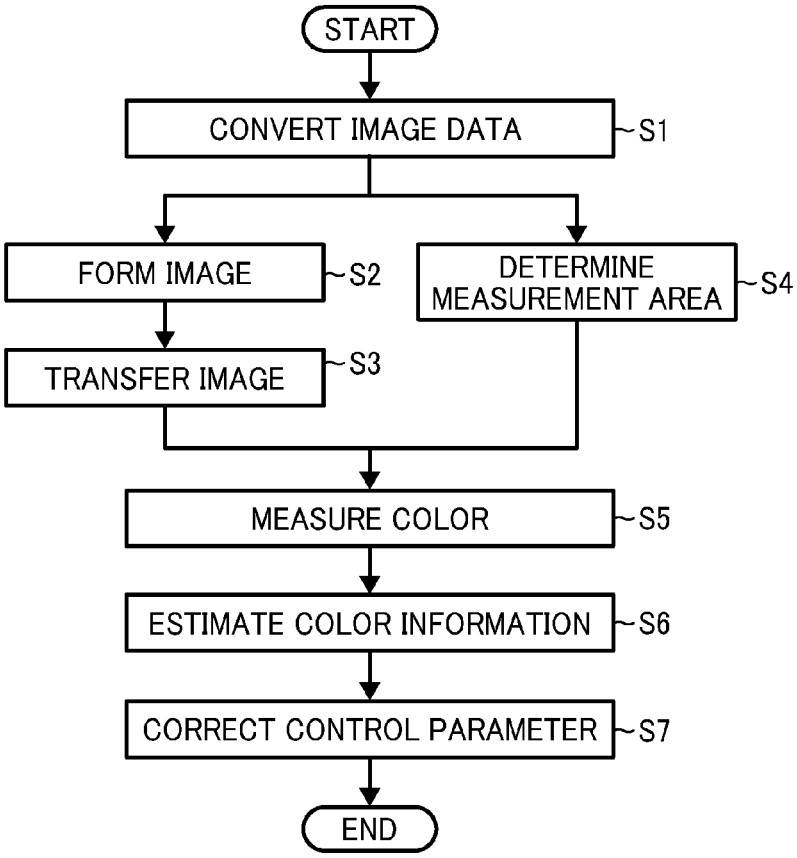
FIG. 9 is a flowchart illustrating operation of performing color stabilization process to improve color stability of an image, performed by the copier of FIG. 1, according to an example embodiment of the present invention.

FIG. 9 is a flowchart illustrating operation of performing color stabilization process, performed by the copier 600, according to an example embodiment of the present invention.

At S1, the main controller 500 obtains input image data, which may be obtained by the scanner 300 or transmitted from the external apparatus. The image data contains pixel values each representing lightness of a single-color component of red (R), green (G), and blue (B) for each of a plurality of pixels arranged in a matrix. The main controller 500 converts the image data into image data containing pixel values each representing lightness of a single-color component of cyan (C), magenta (M), yellow (Y), and black (K).

After conversion of the image data, the main controller 500 concurrently performs the following two operations. One operation is printing operation, which includes image forming at S2 and transferring at S3. The other operation is operation for determining a measurement area to be measured by the spectrometer 900, which is performed at S4.

At S2, as described above referring to FIGS. 1 to 3, four primary color toner images of Y, C, M, and K are respectively formed on the surfaces of the photoconductors 20Y, 20C, 20M, and 20K of the image forming units 18. The four primary color toner images are superimposed one above the other on the surface of the intermediate transfer belt 10 to form a multi-color toner image thereon.

At S3, the multi-color toner image formed on the intermediate transfer belt 10 is transferred to the recording sheet P at the secondary transfer nip. The recording sheet P having the multi-color toner image fixed thereon by the fixing device 25 is further output onto the sheet discharging tray 7.

At S4, the main controller 500 searches an entire section of an image, which is to be formed based on the image data, for a suitable color measurement area that is subjected for color measurement.

After performing printing operation at S2 and S3 and color measurement area determining operation at S4, the operation proceeds to S5 to measure colors of the color measurement area in the multi-color toner image formed on the recording sheet P. At S5, the spectrometer 900 measures colors in the color measurement area selected from the entire section of the multi-color toner image that is formed on the recording sheet P as the recording sheet P is output below the spectrometer 900.

In this example, the copier 600 selects a portion of the entire image as a measurement area subjected for color measurement, measures multi-colors in the selected measurement area of the output image to output a measurement result, estimates primary colors from the measurement result as measured primary colors, and compares the estimated primary colors that are generated based on the measurement result with the primary colors obtained from the image data used for image forming. In alternative to using only a selected portion of the entire image, the copier 600 may divide the entire image into a plurality of measurement areas, and performs color measurement and comparison for each of the measurement areas. However, processing the entire image requires a processor with high-processing capability such that the overall manufacturing costs may increase. This may further increase the processing time. In view of this, in the following examples, the main controller 500 of the copier 600 searches the entire image for a measurement area that is most suitable for color measurement based on information obtainable from the image data. The measurement area suitable for color measurement is an area that is high in flatness in color, or low in color variance. After the measurement area suitable for color measurement is selected, the spectrometer 900 measures colors in the selected measurement area of the output image output by the printer 100 to generate a measurement result. The main controller 500 compares between the colors obtained from the measurement result with the colors obtained from the image data.

The color measurement area is searched as described below. The main controller 500 selects a pixel, which is located at a predetermined position in a pixel matrix represented by the image data, as a target pixel. The main controller 500 further extracts an area having the target pixel at its center and a predetermined size as a subarea. For example, for the first time of extraction, a pixel located on the 51st row, the 51st column from an upper-left corner of the pixel matrix is set as the target pixel; a rectangular area of 101 pixels by 101 pixels (an area of approximately 4 mm per side) where the target pixel is at its center is extracted as the subarea. The main controller 500 calculates flatness indicating the degree of flatness in color tones, or the degree of flatness in lightness, of color through the entire section of the subarea, by referring to the pixel values (C, M, Y, and K) of each pixel in the extracted subarea.

The flatness may be calculated in various ways. In one example, for each color components of C, M, Y, and K, variance of pixel values is obtained. The flatness in the extracted subarea is obtained as a negative value of the sum of variance of pixel values obtained for C, M, Y, and K color components.

In another example, the flatness in the extracted subarea is obtained using variance-covariance matrix. More specifically, variance and covariance of each pixel in the subarea are calculated for each color components of C, M, Y, and K. The variance and the covariance are respectively positioned as diagonal elements and non-diagonal elements to construct the 4×4 variance-covariance matrix. The flatness in the extracted subarea is obtained as a negative value of a solution to this variance-covariance matrix. When compared with the above-described example of obtaining the flatness based on variance of pixel values, the variance-covariance matrix is able to evaluate distribution of colors in the CMYK color space even among different color components.

In another example, the flatness in the extracted subarea is obtained using frequency characteristics of colors. More specifically, the pixel value of each pixel in the extracted subarea is applied with Fourier transformation to obtain the squared sum of the absolute value of Fourier coefficients of a specific frequency. The flatness is obtained as a negative value of this squared sum. In this example, for the specific frequency, more than one frequency may be used. In the above-described example of obtaining the sum of variance of pixel values, for images with halftone processing, the flat area may not be accurately detected due to halftone patterns in the image. In contrary, in the example of obtaining the flatness using the frequency characteristics, the use of squared sum of absolute values of Fourier coefficients is not affected by halftone patterns in the image.

When the flatness in the extracted subarea is obtained, the main controller 500 determines whether all subareas to be extracted have been extracted, or area extraction is completed for the entire image. When it is determined that there is a subarea to be extracted, the main controller 500 shifts the position of a target pixel by one pixel to the right to select a pixel on the 52nd row, the 52nd column from the upper-left corner of the pixel matrix as a target pixel. The main controller 500 further extracts a rectangular area of 101 pixels by 101 pixels having the target pixel at its center as a subarea. The flatness of colors of the extracted subarea is calculated in a similar manner. Subsequently, for extraction of each of a third, a fourth, a fifth, . . . , and an nth subareas, the position of the target pixel is shifted to the right by one pixel. When the position of the target pixel in the row direction has been shifted to a position at 51st from a right end to the left of the matrix, the position of the target pixel in the row direction is returned to the position at 51st from a left end to the right of the matrix and simultaneously the position of the target pixel in the column direction is shifted downward by one pixel.

Thereafter, the operation of shifting the position of the target pixel to the right by one pixel is repeated. The position of the target pixel is shifted one by one as discussed above as in raster scanning to perform extraction across the entire image.

In alternative to shifting the target pixel by one pixel, a subarea to be processed may be extracted from the entire image such that the subarea does not overlap with the adjacent subarea that has been previously extracted. For example, after the rectangular area of 101 pixels by 101 pixels having the 51st row, 51st column, target pixel as its center is extracted, a rectangular area of 101 pixels by 101 pixels having the 152nd row, 152nd column target pixel as its center may be extracted.

When the main controller 500 completes extraction of subareas and calculation of flatness for all subareas of the image data, the main controller 500 selects one of the extracted subareas having the flatness that is most desirable, and determines whether the flatness of the selected extracted subarea is more desirable than a reference flatness value that is previously determined. When it is determined that the flatness of the selected extracted subarea is more desirable than the reference flatness value, the main controller 500 determines that the extracted subarea having the flatness that is more desirable is applicable to color measurement. When it is determined that the flatness of the selected extracted subarea is less desirable than the reference flatness value, the main controller 500 determines that there is no area that is suitable for color measurement at least for the image data to be output.

When there is no measurement area that is most desirable, the main controller 500 may perform color stabilization process using any known method, thus suppressing the degradation in color stability in image.

For example, as described above referring to FIGS. 5 to 7, the main controller 500 causes the primary color toner patch images Py, Pc, Pm, and Pk to be formed on the intermediate transfer belt 10. The optical sensor unit 310 determines toner adhesion amount per unit area of each of the Y, C, M, and K toners on the toner patch images Py, Pc, Pm, and Pk, based on the detection results of the optical sensors that are output as the toner patch images pass across a position immediately below the optical sensors. The main controller 500 compares a calculated value of the Y-toner adhesion amount against a target Y-toner adhesion amount. If the calculated amount is smaller than the target amount, a target Y-toner concentration control value for use in toner supply control is increased. If the calculated amount is greater than the target amount, the target Y-toner concentration control value is lowered. Similarly, target C-, M-, and K-toner concentration control values are corrected based on results of comparison between calculated values of the deposited C-, M-, and K-toner amount and target values for the same. By performing the adhesion-amount stabilizing process to stabilize the toner adhesion amount per unit area on each of the Y-, C-, M-, and K-toner images, color tones of the full-color image, i.e., the multi-color image, are stabilized.

When the measurement area suitable for color measurement is determined at S4, the operation proceeds to S5 to cause the spectrometer 900 to measure multi-colors in the selected measurement area of the multi-color toner image formed on the recording sheet P.

At S6, the main controller 500 obtains estimated primary color information indicating the estimated output value of each of the primary colors constituting the multi-colors in the multi-color toner image, based on multi-color information indicating the multi-color that is obtained from the measurement result obtained at S5, using a color separation model described below.

At S7, the main controller 500 compares the estimated output value of each of the primary colors with a target value of each of the primary colors. The target value of each of the primary colors is determined based on the image data used for forming the primary color image. Based on the comparison, the main controller 500 obtains correction values of control parameters that control image forming conditions, and correct the control parameters using the correction values. In this example, the control parameters to be corrected include a laser intensity (LDP) of the latent-image writing unit 21, an applied charge voltage (Cdc) applied by the charging device 60, and a developing bias voltage (Vb) of the developing device 61. In addition, the toner density of the developer stored in the developing device 61 may be used as control parameters.

Now, operation of estimating primary color information based on multi-color information obtained from the measurement result, which is performed at S6, is explained according to an example embodiment of the present invention.

In this example, the main controller 500 estimates the primary color information regarding a developing density of each one of the primary color toner images that constitute the multi-color toner image formed on the recording sheet. More specifically, the main controller 500 estimates an average value of halftone dot ratios ("the output halftone ratio") of each of the primary color toner images constituting the multi-color toner image, as primary color information for each one of the primary colors.

Figure 10:
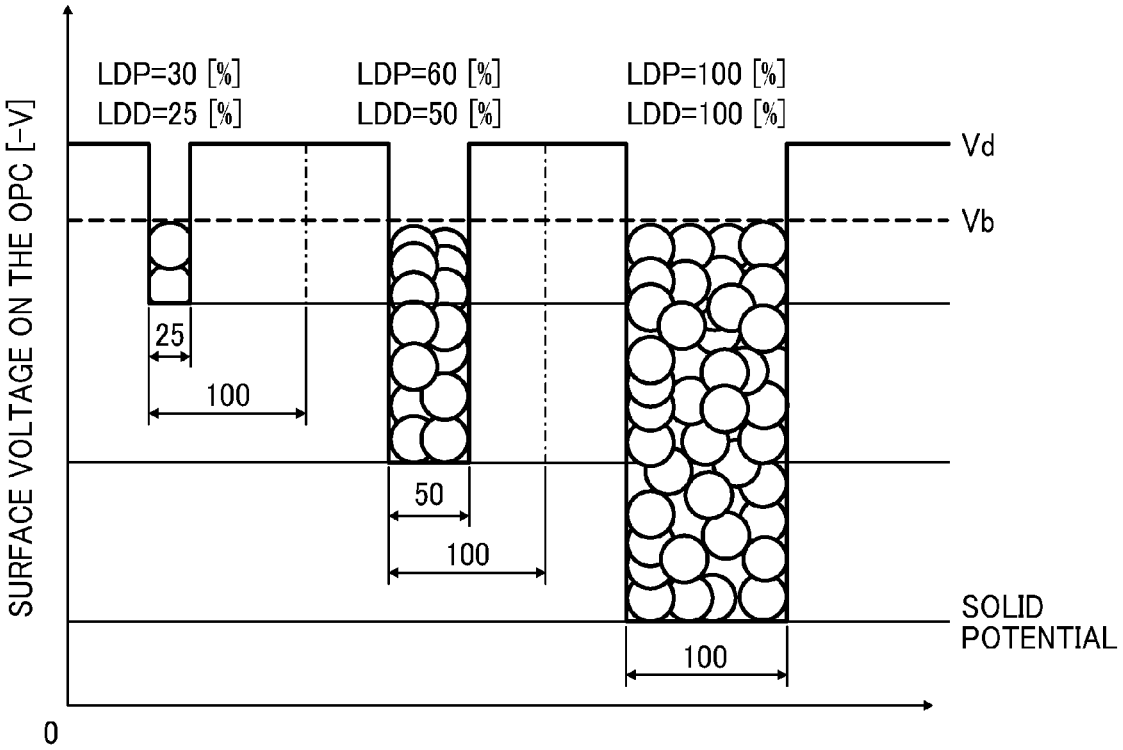
FIG. 10 is an illustration for explaining the relationship between the laser outputs of a latent-image writing unit of the copier of FIG. 1 and the halftone ratios of an image.

FIG. 10 illustrates the relationship between the parameters of the laser outputs of the latent-image writing unit 21 and the halftone ratios of an image. The parameters of the laser outputs of the latent-image writing unit 21, which are adjustable, are the power of the laser diode (LDP) and the duty cycle of the laser diode (LDD). The LDP is the laser intensity of the image writing light irradiated by the latent-image writing unit 21. The LDD is the time the latent-image writing unit 21 spends in irradiating the image writing light per unit time. The halftone ratio is a ratio of an area formed with a toner image over a unit area on a surface of the recording sheet P. The halftone ratio thus corresponds to a ratio of an area formed with a latent image over a unit area on the surface of the photoconductor 20, which is adjustable through control parameters of the laser outputs. For example, when the halftone ratio of the toner image is 50%, the halftone ratio of the latent image is 50%.

As illustrated in FIG. 10, with the increase in LDP and LDD, the amount of toner being supplied onto the surface of the photoconductor 20 increases, thus increasing the image density. The value of LDP and the value of LDD may be changed independently from each other. That is, the image density may be changed with the change in at least one of the LDP and the LDD. Even when the value of LDP remains the same, the image density increases with the increase in LDD. Even when the value of LDD remains the same, the image density increases with the increase in LDP. It is, however, more common to control the image density through changing the value of LDD to obtain gradation in image, and adjust the value of LDP such that a solid image has a predetermined density when LDD is 10%. In the following examples, however, the copier 600 actively changes the value of LDP as control parameter value.

The copier 600 sets an initial value of LDP to be lower than the maximum value of LDP, for example, to 70%. The value of LDP, i.e., the laser intensity, may be adjusted as needed. Unless the control parameter value is not corrected, the LDP value is fixed. Under the fixed LDP value, the value of halftone ratio subjected for control is set such that a desired image density is obtained.

For example, assuming that the LDP is set to 70% and the halftone ratio is set to 40%, a toner image formed on a recording sheet P has a toner adhesion amount per one pixel that corresponds to the laser intensity of 70%, and has an area of 40% with respect to the overall surface of the recording sheet P. Under a desired image forming condition, the output halftone ratio of the toner image output from the copier 600, which may be referred to as the target halftone ratio, is 40%. When a toner adhesion amount per one pixel decreases even with the same image forming condition, while the toner image formed on the recording sheet P has the area of 40% with respect to the overall surface of the recording sheet, the output toner image will have lighter colors. In such case, the output halftone ratio of the toner image output from the copier 600 is less than 40%. The main controller 500 corrects a control parameter for adjusting the laser intensity based on comparison between the output halftone ratio and the target halftone ratio, thus stabilizing the toner adhesion amount. For example, when the output halftone ratio is less than the target halftone ratio, the control parameter is adjusted to increase the laser intensity, thus increasing the toner adhesion amount. When the output halftone ratio is greater than the target halftone ratio, the control parameter is adjusted to decrease the laser intensity, thus decreasing the toner adhesion amount.

More specifically, as long as the output halftone ratio is obtained, the primary color information of each of the primary colors constituting the multi-colors (output halftone ratio) can be compared with the primary color information of each of the primary colors that is obtained from the image data used for image forming (target halftone ratio). Since the toner image formed on the recording sheet P is formed in multi-colors, information regarding the primary colors of the output toner image, or the output halftone ratio, cannot be measured. For this reasons, the main controller 500 estimates the output halftone ratio of each of the primary colors, based on the multi-color information indicating the multi-colors in the multi-color toner image that are measured by the spectrometer 900. The main controller 500 further compares, for each one of the primary colors, the estimated output halftone ratio with the target halftone ratio to obtain a correction value of the control parameter for laser intensity.

The main controller 500 corrects the values of control parameters such as the control parameter for laser intensity (LDP), based on comparison between the output halftone ratio and the target halftone ratio obtained for each of the primary colors. The main controller 500 further corrects the values of control parameters for charge applying voltage and developing bias (Vb), using the correction value of the control parameter for laser intensity.

Now, operation of estimating output halftone ratios of primary colors based on the measurement results of multi-colors is explained.

First, a color separation model is explained. The halftone ratios for the primary colors C, M, Y, and K are respectively expressed as kc, km, ky, and kk. The wavelength of the reflective light used for image writing for each of the primary colors is expressed as λ (nm). The distributions of spectral reflectance for the halftone ratios of the colors C, M, Y, and K are respectively expressed as cyan (kc, λ), magenta (km, λ), yellow (ky, λ), and black (kk, λ). The spectral reflectance distribution is a distribution of reflectance obtained for various wavelength values of reflective lights when a white color light is irradiated. The spectral reflectance distribution for each primary color being obtained is applied with normalization in the wavelength range of 400 nm to 700 nm, such that, assuming that the spectral reflectance distribution of the white-color recording sheet is white (λ), white (λ) is equal to 1 for all ranges of the wavelength λ.

The example case of obtaining the spectral reflectance distribution of magenta (km=0.5, λ) is explained. The spectral reflectance distribution "magenta (0.5, λ)" indicates a distribution of spectral reflectance of a magenta toner image formed on the white-color recording sheet with a halftone ratio of 50%. In this example, spectral reflectance is obtained for the wavelength values ranging between 400 nm and 700 nm, with the increment of 10 nm. More specifically, when the white-color light is irradiated to the magenta toner image with the halftone ratio of 50%, reflectance of the reflective light is obtained for 31 different wavelength values of 400 nm, 410 nm, 420 nm, . . . , and 700 nm. The spectral reflectance distribution "magenta (0.5, λ)" can be thus expressed as a 31×1 matrix.

Further, in this example, the spectral reflectance distribution of the multi-color toner image is defined to be "MixedColor (λ)". In this example, the spectral reflectance distribution of the multi-color toner image is expressed as a product of the spectral reflectance distributions of primary color toner images constituting the multi-color toner image, as indicated by the equation 1 of FIG. 14A.

Since the spectral reflectance distribution for each of the colors can be expressed as a 31×1 matrix, the equation 1 of FIG. 14A, which is the color separation model, is defined to be the equation 2 of FIG. 14A. In the equation 2, $\lambda_{400}$ to $\lambda_{700}$ respectively indicate the reflectance of the reflective lights having the wavelength values of 400 nm to 700 nm.

As illustrated in the equation 3 of FIG. 14A, when the difference between the left side of the equations 1 and 2 and the right side of the equations 1 and 2 is defined to be "J", which can be obtained as the L2 norm, the difference "J" should be "0".

The left and right sides of the equation 3 are respectively squared to obtain the equation 4 of FIG. 14A.

The spectral reflectance distribution "MixedColor (λ)" corresponds to the multi-colors measured from the multi-color toner image formed on the recording sheet P that is output from the copier 600. The output halftone ratio of each of the primary colors constituting the multi-color toner image is supposed to be substantially the same as the target halftone ratio of each of the primary colors that is obtained from the image data, unless an image forming condition rapidly changes between the time when the image data is analyzed and the time when the image is formed based on the image data. In this example, the target halftone ratio is set at the time the latent image is formed, using information obtainable from the image data used for forming the latent image. For each primary color, the main controller 500 searches for a halftone ratio that is close in value to the target halftone ratio such that the difference "J" indicated by the equations 3 and 4 is made nearly "0" to obtain the estimated output value of halftone ratio of the primary color constituting the multi-color toner image being output.

Now, a primary color data table, which is used for estimating the output halftone ratio of the primary color, is explained.

In estimating the value of output halftone ratio of the primary color, the copier 600 may use an algorithm for estimating the value of output halftone ratio of the primary color. To construct the algorithm, the spectral reflectance distributions cyan (kc, λ), magenta (km, λ), yellow (ky, λ), and black (kk, λ), each corresponding to the estimated output value of halftone ratio, need to be obtained for the primary colors C, M, Y, and K. Generally, it is difficult to prepare data for arbitrary values of halftone ratios kc, km, ky, and kk. For this reasons, in this example, the halftone ratio values for each primary color are discretized by increments of 10% such that 10 halftone ratio values of kc1 to kc10, km1 to km10, ky1 to ky10, and kk1 to kk10 are obtained for cyan, magenta, yellow, and black. For each primary color, the spectral reflectance distribution of the primary color with respect to 10 discrete halftone ratio values is stored in the primary color data table. More specifically, the primary color data table stores, for each of the discrete halftone ratios of each primary color, the spectral reflectance distribution data that is obtained from the measurement result of the primary color toner image having the corresponding halftone ratio. The primary color data table is stored in the ROM 503.

In constructing the algorithm for estimating the output halftone ratio for each primary color, candidate values of estimated output halftone ratio are generated using the target halftone ratio that is obtained from the measurement area of the image data to be formed. The candidate estimated output values of halftone ratio are halftone ratio values that are close to the target halftone ratio value. Using the primary color data table, for each of the primary colors, the spectral reflectance distribution that corresponds to each one of the candidate estimated output values of halftone ratio is generated. For example, assuming that the target halftone ratio is 55%, the spectral reflectance distribution is obtained for each of the candidate estimated output values of halftone ratio, such as the halftone ratio value of 50%, the halftone ratio value of 60%, etc. The spectral reflectance distributions of the candidate estimated output values of halftone ratio for the respective primary colors, that is, cyan (kc, λ), magenta (km, λ), yellow (ky, λ), and black (kk, λ), are input to the equation 3 and the equation 4. Using the equations 3 and 4, one of the candidate estimated output values of halftone ratio that can minimize the difference "J" is obtained for each primary color, as the estimated output value of halftone ratio for each primary color.

For example, when the target halftone ratio is 50% for the multi-color toner image of red such that the spectral reflectance distribution of the multi-color can be expressed as red (05, λ), the spectral reflectance distribution of the multi-color "red (0.5, λ)" is defined to be equal to a product of the magenta spectral reflectance distribution "magenta (0.5, λ)" and the yellow spectral reflectance distribution "yellow (0.5, λ)", as indicated by the equation 5 of FIG. 14B.

In reality, however, the difference "J" of the equation 3 and the equation 4, functioning as the evaluation function, is not always minimized even the color separation model of the equation 5 is used, for various reasons. For example, characteristics in image forming engine such as the developing capability may change, thus causing the characteristics of primary colors to be different from the characteristics of the primary colors that are stored in the primary color data table. In view of this, it is assumed that the target halftone ratio obtained from the image data does not fully reflect the output halftone ratio. As described above, for each primary color, candidates of estimated output values of halftone ratio are generated, which are the output halftone ratio values that are close to the target halftone ratio value.

For example, in the above-described example in which the multi-color toner image is formed with the target halftone ratio of 50%, the spectral reflectance distribution for red color toner image "red (0.5, λ)" is expressed as a combination of magenta spectral reflectance distribution "magenta (0.5, λ)" and yellow spectral reflectance distribution "yellow (0.5, λ)". In such case, as indicated by the equation 6 of FIG. 14B, the total of 9 candidate estimated output values of halftone ratio are generated. The number of candidate estimated output values is, however, not limited to 9 such that more than 9 candidate estimated output values may be generated.

In case any value that is not registered in the primary color data table is used as a candidate halftone ratio value, the spectral reflectance distribution that corresponds to such candidate halftone ratio value may be obtained by interpolating the halftone ratio values that are registered in the primary color data table. In case of obtaining spectral reflectance for a cyan halftone ratio kc' that is not registered in the primary color data table, information obtained from the cyan primary color data table that stores the spectral reflectance in association with 10 halftone ratios kc1 to kc10 is used. Assuming that kcn<kc'<kc(n+1), and 1<=n<=9, the spectral reflectance distribution cyan (kc', λ) is calculated using the equation 7 of FIG. 14B.

Now, operation of correcting control parameters such as laser intensity, charge applying voltage, and developing bias is explained. In this example, a potential value table is prepared, which is used for correcting the control parameters. The potential value table stores a set of table numbers and control parameter values. With the decrease in table number, the developing density decreases. With the increase in table number, the developing density increases.

The main controller 500 compares the target halftone ratio obtained from the image data with the estimated output value of halftone ratio. When the target halftone ratio is greater than the estimated output halftone ratio, the table number is increased. When the target halftone ratio is less than the estimated output halftone ratio, the table number decreases. The main controller 500 searches the potential value table for control parameter values that correspond to the table number, which is increased or decreased, and changes an image forming condition according to the control parameter values. More specifically, the control parameters for the image forming unit 18 and the latent-image writing unit 21 are corrected based on the obtained control parameter values.

In the above-described example, when comparing between the estimated primary color information that is estimated based on the measurement result and the target primary color information, the halftone ratio is used as the primary color information. More specifically, the estimated output value of halftone ratio is used as the estimated primary color information, and the target halftone ratio is used as the target primary color information. In alternative to or in addition to the halftone ratios, any other information may be used as the estimated primary color information and the target primary color information.

The primary color data table stores, for each of the primary colors, a plurality of spectral reflectance distributions in association a plurality of halftone ratio values. Using the primary color data table, the spectral reflectance distribution for the estimated output halftone ratio values and the target halftone ratio value can be calculated for each primary color. Based on the spectral reflectance distribution, L*a*b* values can be obtained using any desired known method. The L*a*b* values that correspond to the estimated output halftone ratios may be used as the estimated primary color information, and the L*a*b* values that correspond to the target halftone ratio may be used as the target primary color information. Based on comparison between the estimated primary color information and the target primary color information, the image forming condition of the primary color toner image is controlled.

When comparing the L*a*b* values between the estimated primary color information and the target primary color information, one color component selected from L*, a*, and b* components may be only used, such as the color component that is most sensitive to the change in toner adhesion amount. When comparing the color components in the multi-color toner image, even when the L* value remains the same, the a* value or the b* value may change. In contrary, when comparing the color components in the primary color toner image, once the value of one color component is determined, the other two color components each have the values determined based on the determined value of one color component such that the a* and the b* values remain the same when the L* value remains the same. For example, the main controller 500 may use the L* value for analysis of the cyan color, the a* value for analysis of the magenta color, and the b* value for analysis of the yellow color. Based on the comparison result in L*, a*, or b* value obtained for each primary color, the main controller 500 determines whether the image density of the primary color toner image is higher or lower than the desired image density.

The above-described color stabilization process was performed using a test apparatus that has the same structure as the copier 600. Using the test apparatus, which is referred to as the copier 600, a 3-color ("3C") grayscale image having the halftone ratio of 70% is formed on a recording sheet P, while performing the above-described color stabilization process. During the experiments, image forming is sequentially performed for 50 times such that 50 grayscale images are output. To form the 3C grayscale image having the halftone ratio of 70%, the copier 600 forms the cyan toner image having the target halftone ratio of 70%, the magenta toner image having the target halftone ratio of 70%, and the yellow toner image having the target halftone ratio of 70%, respectively, on the surfaces of the photoconductors 20. These primary color toner images are superimposed one above the other on the intermediate transfer belt 10, and transferred to the recording sheet P to form the multi-color toner image thereon. After being fixed, the multi-color toner image is output as the 3C grayscale toner image on the sheet discharge tray 7. Using the spectrometer 900, the copier 600 measures spectral reflectance of a color measurement area in the grayscale toner image formed on the recording sheet P. More specifically, the spectrometer 900 irradiates a light to the color measurement area of the grayscale toner image. In this example, the D65 light source is used as a light source for irradiating the light.

Figure 11A:
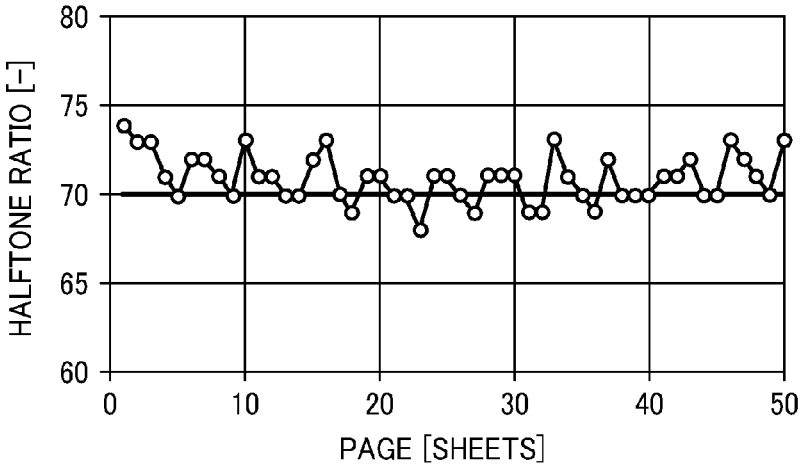
FIG. 11A is a graph illustrating the change in estimated output value of halftone ratio with respect to the target halftone ratio for the cyan toner image, as the color stabilization process of FIG. 9 is performed.
Figure 11B:
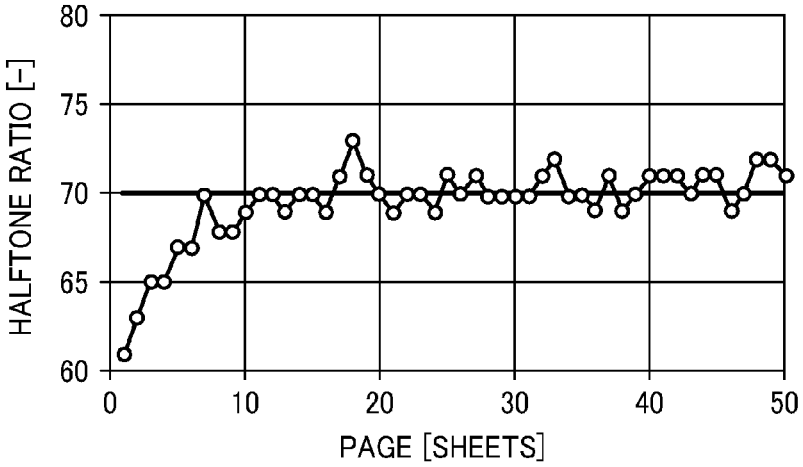
FIG. 11B is a graph illustrating the change in estimated output value of halftone ratio with respect to the target halftone ratio for the magenta toner image, as the color stabilization process of FIG. 9 is performed.
Figure 11C:
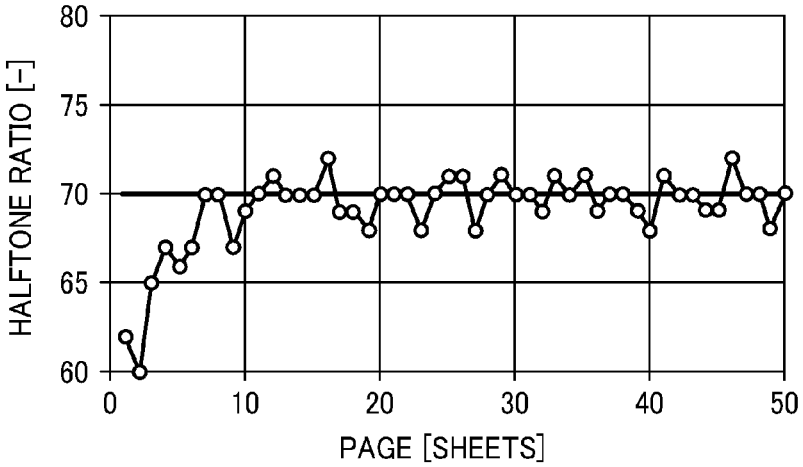
FIG. 11C is a graph illustrating the change in estimated output value of halftone ratio with respect to the target halftone ratio for the yellow toner image, as the color stabilization process of FIG. 9 is performed.

FIGS. 11A to 11C are graphs illustrating the change in estimated output halftone ratio with respect to the target halftone ratio of 70% for each color of cyan, magenta, and yellow. In FIGS. 11A to 11C, the vertical axis indicates the value of halftone ratio, with the horizontal line indicating the target halftone ratio of 70%, and the circle plots indicating the estimated output halftone ratios. The horizontal axis indicates an accumulated number of printed images.

As illustrated in FIG. 11, for the first printed image, the estimated output halftone ratio is deviated from the target halftone ratio of 70% for each of cyan, magenta, and yellow. The copier 600 compares between the estimated output value of halftone ratio and the target halftone ratio of 70%, corrects control parameter values of image forming condition such that the difference between the estimated output halftone ratio and the target halftone ratio becomes nearly 0. By repeating this color stabilization process, as illustrated in FIGS. 11A to 11C, the estimated output halftone ratio becomes closer to the target halftone ratio of 70% from about the 10th printed image.

Figure 12A:
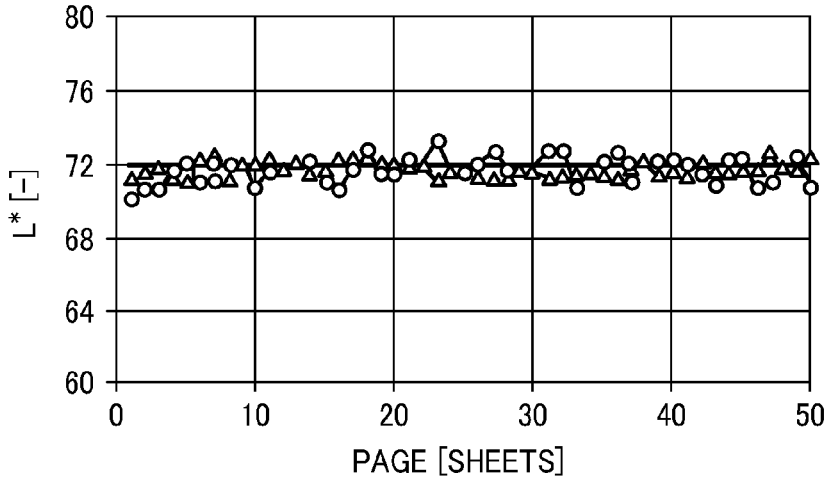
FIG. 12A is a graph illustrating the change in estimated output value of L* and measured output values of L*, with respect to the target L* value for the cyan toner image, as the color stabilization process of FIG. 9 is performed.
Figure 12B:
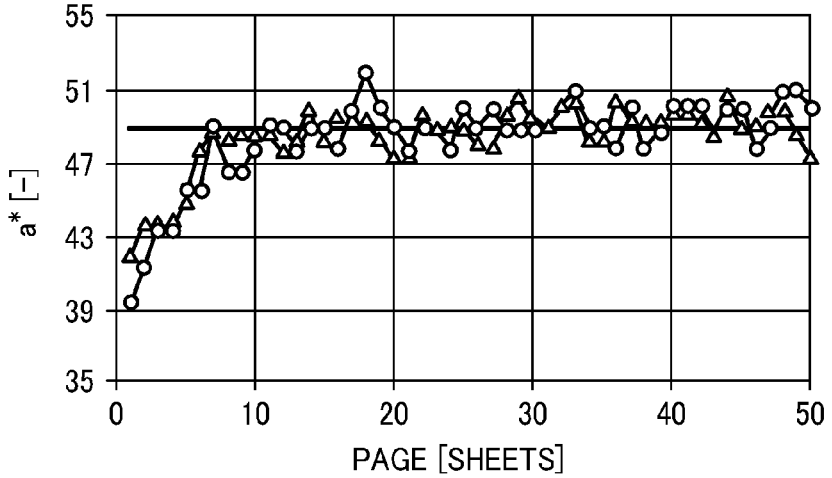
FIG. 12B is a graph illustrating the change in estimated output value of a* and measured output values of a*, with respect to the target a* value for the magenta toner image, as the color stabilization process of FIG. 9 is performed.
Figure 12C:
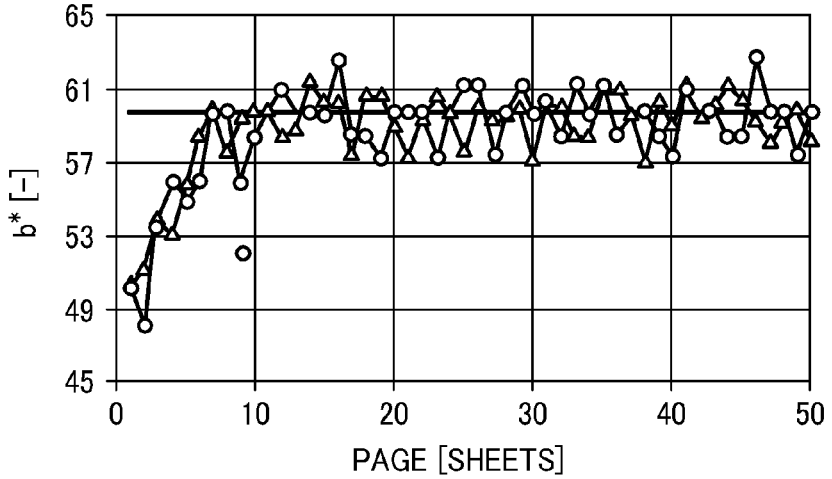
FIG. 12C is a graph illustrating the change in estimated output value of b* and measured output values of b*, with respect to the target b* value for the yellow toner image, as the color stabilization process of FIG. 9 is performed.

FIGS. 12A and 12C are graphs illustrating the change in the L*a*b* values that are calculated using the spectral reflectance distribution of the primary colors of cyan, magenta, and yellow. More specifically, each of the L*, a*, and b* values of FIGS. 12A to 12C is calculated based on one of the color components that is most sensitive to the density change in the primary color toner image.

The graph of FIG. 12A shows the change in estimated output value of L* indicated by the circle plots, and the change in measured output value of L* indicated by the triangle plots, with respect to the target L* value indicated by the straight line. The L* value for the target halftone ratio of 70% is 72. Further, the L* value for the target halftone ratio is obtained by measuring the cyan color toner image with the halftone ratio of 70%, before printing the user image. The estimated output value of L* is calculated based on the spectral reflectance distribution of cyan, using the estimated output halftone ratio. The measured output L* value is obtained by the line spectrometer 900 by measuring the cyan color toner image, which is formed with the target halftone ratio of 70% at a position adjacent to the 3C grayscale image with the halftone ratio of 70%.

The graph of FIG. 12B shows the change in estimated output value of a* indicated by the circle plots, and the change in measured output value of a* indicated by the triangle plots, with respect to the target a* value indicated by the straight line. The a* value for the target halftone ratio of 70% is 49. Further, the a* value for the target halftone ratio is obtained by measuring the magenta color toner image with the halftone ratio of 70%, before printing the user image. The estimated output value of a* is calculated based on the spectral reflectance distribution of magenta, using the estimated output halftone ratio. The measured output a* value is obtained by the line spectrometer 900 by measuring the magenta color toner image, which is formed with the target halftone ratio of 70% at a position adjacent to the 3C grayscale image with the halftone ratio of 70%.

The graph of FIG. 12C show the change in estimated output value of b* indicated by the circle plots, and the change in measured output value of b* indicated by the triangle plots, with respect to the target b* value indicated by the straight line. The b* value for the target halftone ratio of 70% is 60. Further, the b* value for the target halftone ratio is obtained by measuring the yellow color toner image with the halftone ratio of 70%, before printing the user image. The estimated output value of b* is calculated based on the spectral reflectance distribution of yellow, using the estimated output halftone ratio. The measured output b* value is obtained by the line spectrometer 900 by measuring the yellow color toner image, which is formed with the target halftone ratio of 70% at a position adjacent to the 3C grayscale image with the halftone ratio of 70%.

As illustrated in FIGS. 12B and 12C, for magenta and yellow, the estimated *a and *b* values for the estimated output halftone ratio and the measured a* and b* values are each deviated from the target a* and b* values for the target halftone ratio of 70%. The copier 600 continuously performs the above-described color stabilization process so as to cause the difference between the estimated output halftone ratio and the target halftone ratio to be minimum. Referring to FIGS. 12B and 12C, after performing color stabilization process, the estimated a* and b* values for the estimated output halftone ratio and the measured a* and b* values reach the target a* and b* values for the target halftone ratio, about from the time at which the 10th printed image is output.

Figure 13:
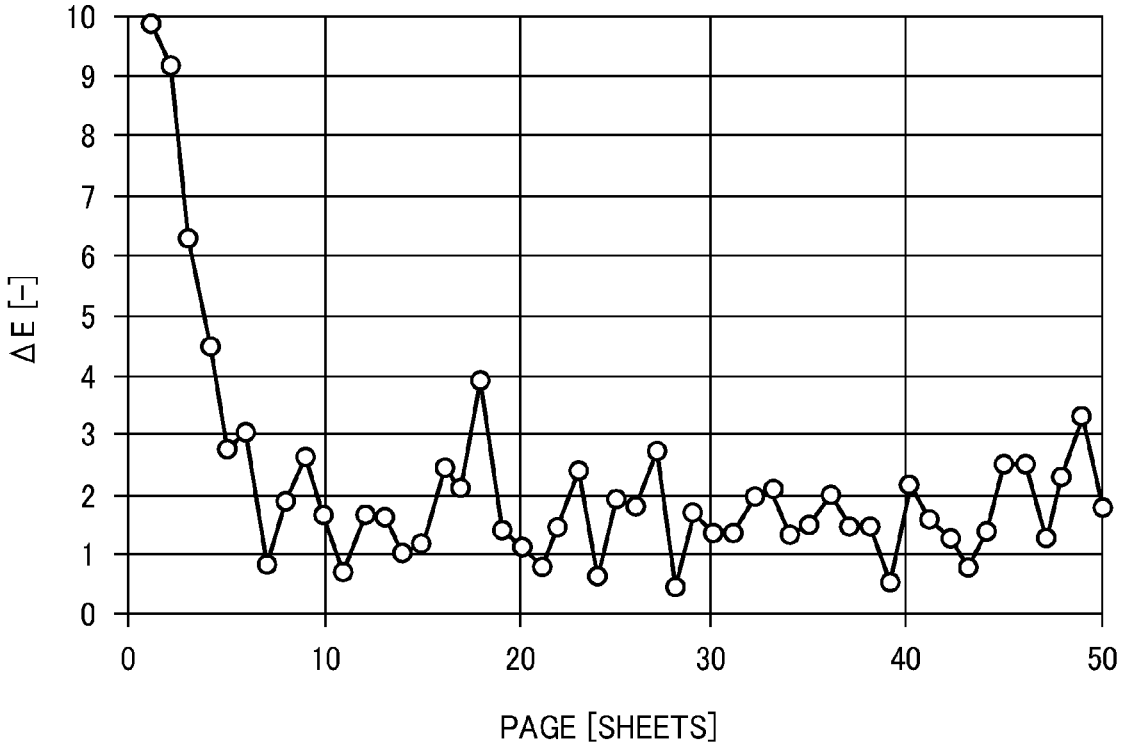
FIG. 13 is a graph illustrating the change in color difference between the output value of grayscale image and the target value of grayscale image, as the color stabilization process of FIG. 9 is performed.

FIG. 13 is a graph illustrating the change in color difference between the target value of the 3C grayscale image, and the output value of the 3C grayscale image having the halftone ratio of 70%, as printing is performed for 50 times. The L*a*b* values, which indicate the target value of the 3C grayscale image with the halftone ratio of 70%, are obtained by measuring the 3C grayscale image having the halftone ratio of 70% before the first user image is printed.

As illustrated in FIG. 13, for the first printed image, the color difference between the target value of the 3C grayscale image and the output value of the 3C grayscale image is relatively large. The copier 600 continuously performs the above-described color stabilization process so as to cause the difference between the estimated output halftone ratio and the target halftone ratio to be minimum. Referring to FIG. 13, after performing color stabilization process, the color difference between the output value of the 3C grayscale image and the target value of the 3C grayscale image becomes lower than 4, about from the time at which the 5th printed image is output.

As shown in the experiments discussed above referring to FIGS. 11, 12, and 13, the primary color information is estimated with improved accuracy such that the primary colors and the multi-colors in the output image can be effectively stabilized.

In this example, the copier 600 includes a plurality of photoconductors 20 each functioning as a latent image carrier. The copier 600 forms the primary color toner images respectively on the surfaces of the photoconductors 20, and primary-transfers the primary color toner images onto the intermediate transfer belt 10 one above the other to form the multi-color toner image. The multi-color toner image formed on the intermediate transfer belt 10 is secondary transferred to the recording sheet P for output. Further, the copier 600 estimates the primary color information of each of the primary color toner images that constitute the multi-color toner image, based on the multi-color information obtained from the measurement result of the multi-color toner image formed on the recording sheet P. Using the estimated primary color information and target primary color information, the copier 600 corrects an image forming condition of each of the primary color toner images. This color stabilization process may be applicable to any image forming apparatus having a structure different from that of the copier 600.

For example, in alternative to forming the primary color toner images on the intermediate transfer belt 10, the primary color toner images formed on the surfaces of the latent image carriers may be directly transferred onto the surface of the recording sheet, one above the other, to form the multi-color toner image thereon.

In another example, the image forming apparatus may be provided with only one latent image carrier. In such case, the primary color toner images are formed on the surface of the latent image carrier, one by one, using a plurality of developing devices that are disposed along the circumferential direction of the latent image carrier. The primary color toner image firstly formed on the surface of the latent image carrier is transferred onto an intermediate transfer body. The primary color toner image secondly formed on the surface of the latent image carrier is transferred onto the intermediate transfer body so as to cause the secondly formed image to be superimposed over the firstly formed image. This transfer process is repeated to form the multi-color toner image on the intermediate transfer body. The multi-color toner image is then transferred onto the recording sheet. Further, the image forming apparatus having a single latent image carrier is provided with a plurality of charging devices and a plurality of exposure devices in addition to the developing devices.

The above-described color stabilization process is thus applicable to an image forming apparatus that forms the multi-color toner image on the recording sheet by superimposing the primary color toner images one above the other.

As described above, in this example, the copier 600 includes four image forming units 18Y, 18C, 18M, and 18K, the latent image writing unit 21, the intermediate transfer belt 10, the secondary transfer roller 24, the line spectrometer 900, and the main controller 500. The latent image writing unit 21 and the image forming units 18 provide an image forming function of forming the primary color toner images of yellow, cyan, magenta, and black on the surfaces of the photoconductors 20Y, 20C, 20M, and 20K each functioning as the latent image carrier. The intermediate transfer belt 10 and the secondary transfer roller 24 provide a transfer function of transferring the primary color toner images formed on the surfaces of the photoconductors 20 to the recording sheet P functioning as a recording medium, via the intermediate transfer belt 10 functioning as an intermediate transfer body. In the copier 600, the primary color toner images formed on the photoconductors 20 are superimposed one above the other on the intermediate transfer belt 10 to form the multi-color toner image. The multi-color toner image is further transferred onto the recording sheet P. The line spectrometer 900 provides an output image color measuring function of measuring the colors of the multi-color toner image formed on the recording sheet P to obtain the spectral reflectance distribution of the multi-color toner image as the multi-color information of the output image. The main controller 500 provides an image forming condition control function of controlling an image forming condition of the primary color toner image, with respect to the latent image writing unit 21 and the image forming units 18.

With the above-described structures and functions, the main controller 500 additionally provides an image information color separation function. More specifically, the main controller 500 estimates the output value of halftone ratio of each primary color based on the spectral reflectance distribution of the multi-color toner image that is obtained by the line spectrometer 900, as the primary color information of each of the primary colors constituting the multi-colors in the multi-color toner image. The main controller 500, which provides the image forming condition control function, corrects the image forming condition of the primary color toner image, based on the estimated output halftone ratio of the primary color. More specifically, the main controller 500 sets, for each of the primary colors, the target halftone ratio as the target color information. The main controller 500 compares between the estimated output halftone ratio that is estimated based on the measurement result, and the target halftone ratio, for each of the primary colors. In this example, the target halftone ratio, which is the target color information of the primary color, is determined based on color information of the primary color toner that is used for forming the primary color toner image based on the input image data. Since the halftone ratios subjected for comparison are both the halftone ratios of the same primary color, the main controller 500 can easily determine the degree of darkness or lightness in color by simply comparing the halftone ratios. When the estimated output primary color is lighter than the target primary color, the main controller 500 corrects the image forming condition of the primary color toner image such that the developing density is increased. When the estimated output primary color is darker than the target primary color, the main controller 500 corrects the image forming condition of the primary color toner image such that the developing density is decreased.

For each of the primary colors, information used for correcting an image forming condition, which causes the difference between the estimated output primary color such as the estimated output halftone ratio, and the target primary color such as the target halftone ratio, to be minimum. Since the color stabilization process can be performed based on comparison in halftone ratio of the primary color, information, or a number of control factors, to be previously prepared can be greatly reduced, for example, when compared with the case where comparison is performed based on the multi-color information. Since the number of control factors can be reduced, the amount of information that can be previously stored for each control factor may increase, thus increasing the accuracy in stabilization process. Further, the main controller 500 is able to correct the image forming condition of the copier 600 based on the measurement result of the output multi-color toner image, thus improving color stability of the output image.

As described above, the color information subjected for comparison is not limited to the halftone ratio. For example, any color information such as the L*a*b* value may be used as long as it can be obtained from the spectral reflectance distribution obtained by the line spectrometer 900 based on the measurement result of the multi-color toner image.

The main controller 500, which provides the image forming color separation function, is provided with a ROM 503 that provides the primary color spectral reflectance distribution storage function. The ROM 503 previously stores information regarding the spectral reflectance distribution of the primary color toner image for a plurality of halftone ratios. The main controller 500 generates a plurality of candidate estimated output values of halftone ratio, based on the image information of the input image data. The main controller 500 further generates an estimated spectral reflectance distribution that corresponds to the candidate estimated output values of halftone ratio, based on the information stored in the ROM 503. The main controller 500 searches for the candidate estimated output value of halftone ratio that causes the difference between the estimated output halftone ratio and the target halftone ratio, such as the L2 norm value ("J" in equation 3), to be minimum. The L2 norm value is the difference between the product of the spectral reflectance distributions of the respective primary colors that constitute the multi-color toner image, and the spectral reflectance distribution of the multi-color toner image that is obtained from the measurement result of the line spectrometer 900, as indicated by the equation 3. The candidate estimated output value obtained through searching is defined to be the estimated output value of halftone ratio of the primary color. In this manner, the main controller 500 is able to estimate the output halftone ratio of each of the primary color toner images that constitute the multi-color toner image, which is not directly obtainable from the multi-color toner image that is measured from the output image.

The main controller 500 sets the target halftone ratio based on the image information of the input image data, as the target value of the primary color information. When the estimated output value of halftone ratio is less than the target halftone ratio, the main controller 500 corrects an image forming condition so as to increase a developing density. When the estimated output value of halftone ratio is greater than the target halftone ratio, the main controller 500 corrects an image forming condition so as to decrease a developing density. Once the output halftone ratio for each primary color is estimated, the target halftone ratio and the estimated output halftone ratio are compared with each other to generate a comparison result, or the difference. Based on the difference, the image forming condition of the primary color toner image is corrected with improved accuracy.

The main controller 500 also provides a color measurement area determining function of determining a color measurement area suitable for measurement by the spectrometer 900, from the output image. The main controller 500 selects a color measurement area that is suitable for color measurement from the entire image, and obtains the measured multi-colors from the color measurement area to be used for comparison. This increases the overall processing speed, while keeping a sufficient level of accuracy. More specifically, the main controller 500 searches for an area that is high in the degree of flatness in color tones.

The copier 600 includes the latent-image writing unit 21 that forms a latent image on the surface of the photoconductor 20 functioning as the latent image carrier, and a plurality of developing devices 61 each developing the latent image formed on the photoconductor 20 into a toner image with toner. The latent-writing unit 21 optically scans the surface of the photoconductor 20 that is uniformly charged by the charging device 60 to form the latent image thereon. The developing device 61 applies developing bias to the developing sleeve 65, which carries the developer on its surface, to cause toner in the developer formed on the developing sleeve 65 to be transferred to the latent image formed on the photoconductor 20. The main controller 500 corrects at least one of the charging intensity of the developing device 60, the light writing intensity of the latent-image writing unit 21, the developing bias, and toner density in the toner image. In this manner, image forming conditions of forming the primary color images are corrected based on comparison in primary color information.

The developing device 61 develops the latent image using the developer containing toner particles and carrier particles. Based on the difference between the detected toner density in developer stored in the developing device 61 that is obtained by the toner density sensor 71, and the target toner density, toner is supplied from the toner supply port 61*a* into the developing device 61. The main controller 500 corrects the target toner density based on comparison in primary color information. More specifically, toner density is corrected as a control parameter of the image forming condition.

In the above-describe example, the copier 600 is provided with the line spectrometer 900 that measures multi-colors of the output image of the copier 600 by spectral reflectance. Alternatively, the copier 600 may be provided with a control scanner 800 that detects the RGB values of the output image formed on the recoding sheet P. The control scanner 800 may be disposed at the position at which the line spectrometer 900 is disposed, as illustrated in FIG. 1.

More specifically, referring to FIG. 1, the control scanner 800 is provided above the sheet discharge tray 7. The control scanner 800 measures colors of the multi-toner image formed on the recording sheet that is discharged onto the sheet discharge tray 7, in this case, the RGB values of the multi-color toner image. Assuming that a length in the main scanning direction of an image forming area that corresponds to a A4 size recording sheet P ranges between 0 mm to 210 mm, the control scanner 800 detects RGB values at a total of 22 positions in the main scanning direction length, which are each incremented by 10 mm. Further, the control scanner 800 detects the RGB values in the sub-scanning direction, that is, the sheet conveying direction, for each position that is incremented by 10 mm. For each of 22 positions in the main scanning direction length at which the RGB value is detected, colors of a square-shaped area of 10 mm by 10 mm are measured, such that 22 color measurements are obtained. The RGB value of the printed image is an average value of the 22 color measurements obtained from the square-shaped areas.

The main controller 500 performs the color stabilization process in a substantially similar manner as described above for the case where the colors of the output image are measured by the spectrometer 900. The copier 600 causes the control scanner 800 to obtain information regarding the multi-colors of a user image, as multi-color information. Based on the obtained multi-color information, the main controller 500 estimates information regarding each of the primary colors Y, M, C, and K that constitute the multi-colors in the multi-color toner image being output, as primary color information. For each of the primary colors Y, M, C, and K, the main controller 500 determines correction values of control parameters that control image forming conditions of the copier 600, based on the difference between the estimated primary color information estimated from the multi-color information of the measurement result, and target primary color information previously obtained. The main controller 500 further corrects the control parameters such as control parameters regarding the image forming unit 18 or the latent-image writing unit 21, using the determined correction values. The control parameters to be corrected include, for example, a target control value of toner density in the developing device 61, a developing bias (Vb), a light intensity (LDP) of the image writing light that is irradiated by the latent-image writing unit 21 onto the surface of the photoconductor 20.

In this example, since the multi-color information is measured in RGB values using the control scanner 800, the main controller 500 converts the measured RGB values to the L*a*b* values to obtain the measured L*a*b* values. Further, the main controller 500 obtains the spectral reflectance distribution of each of the primary colors in a substantially similar manner as described above in the case of using the spectrometer 900. The main controller 500 calculates the spectral reflectance distribution of the multi-colors in the multi-color toner image using the obtained spectral reflectance distributions of the primary colors, and converts the spectral reflectance distribution of the multi-colors into the L*a*b* values to obtain the estimated output L*a*b* values. The main controller 500 calculates the color difference between the estimated output L*a*b* values and the measured output L*a*b* values, and searches for a set of estimated output values of halftone ratio that can minimize the color difference. The color difference between the estimated output L*a*b* values and the measured output L*a*b* values may be calculated using any desired model such as the CIEDE94 model, or CIEDE2000 model.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the spirit and scope of the present invention, and all such modifications are intended to be included within the scope of the present invention.

For example, elements and/or features of different illustrative embodiments may be combined with each other and/or substituted for each other within the scope of this disclosure and appended claims.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, nonvolatile memory cards, ROM (read-only-memory), etc.

Alternatively, any one of the above-described and other methods of the present invention may be implemented by ASIC, prepared by interconnecting an appropriate network of conventional component circuits or by a combination thereof with one or more conventional general purpose microprocessors and/or signal processors programmed accordingly.

In one example, the present invention may reside in an image forming apparatus comprising: image forming means for forming a plurality of primary color toner images of primary colors on a latent image carrier based on input image information; transferring means for forming a multi-color toner image that is generated by superimposing the primary color toner images formed on the latent image carrier one above the other onto a recording sheet, by transferring directly, or indirectly via an intermediate transfer body, the primary color toner images formed on the latent image carrier to the recording sheet; output image measuring means for measuring multi-colors of the multi-color toner image formed on the recording sheet to obtain multi-color information of the output image; and image forming condition control means for controlling an image forming condition of each of the primary color toner images with respect to the image forming means. The image forming apparatus further includes image information color separation means for estimating primary color information of each of the primary color toner images that constitute the multi-color toner image, based on the multi-color information obtained by the output image measuring means. The image forming condition control means corrects the image forming condition of each of the primary color toner images, based on the primary color information estimated by the image information color separation means.

In one example, the image forming means corresponds to the latent-image writing unit 21, and the image forming units 18. The latent image carrier corresponds to one or more photoconductors 20. The transferring means corresponds to one or more transfer rollers 62, and the secondary transfer roller 24. The intermediate transfer body corresponds to the intermediate transfer belt 10. The measuring means corresponds to the spectrometer 900, or the control scanner 800. The control means and the color separation means correspond to the main controller 500.

In the above-described example, the multi-color information obtained by the measuring means is a spectral reflectance distribution of the multi-color toner image. The image information color separation means includes primary color spectral reflectance distribution storage means, which previously stores, for each of the primary colors, information indicating the spectral reflectance distribution of the primary color toner image for each one of a plurality of halftone ratios. The image information color separation means generates a plurality of candidate values of estimated output halftone ratio based on the input image information, as the primary color information. The estimated output halftone ratio is an estimated value of output halftone ratio of the primary color toner image in the multi-color toner image formed on the recording sheet. The image information color separation means generates, for each one of the primary colors, an estimated spectral reflectance distribution that corresponds to each one of the candidates of estimated output halftone ratio, based on the information stored in the primary color spectral reflectance distribution storage means. The image information color separation means searches for one of the candidate values of estimated output halftone ratio that causes a L2 norm value to be minimum, the L2 norm value being a difference between a product of the estimated spectral reflectance distributions of the primary color toner images that constitute the multi-color toner image, and the spectral reflectance distribution of the multi-color toner image obtained by the output image measuring means. The image information color separation means defines one of the candidate values of estimated output halftone ratio that is searched to be the estimated output halftone ratio of each of the primary colors.

In one example, the multi-color information obtained by the output image measuring means is a RGB value of the multi-color toner image. The image information color separation means includes primary color spectral reflectance distribution storage means, which previously stores, for each of the primary colors, information indicating the spectral reflectance distribution of the primary color toner image for each one of a plurality of halftone ratios. The image information color separation means generates a plurality of candidate values of estimated output halftone ratio, based on the input image information. The image information color separation means further generates an estimated spectral reflectance distribution that corresponds to each one of the candidate values of estimated output halftone ratio based on the information stored in the primary color spectral reflectance distribution storage means. The image information color separation means converts a product of the spectral reflectance distributions of the primary color toner images constituting the multi-color toner image into estimated L*a*b* values, and converts the RGB values of the multi-color toner image that is obtained by the output image measuring means into measured L*a*b* values. The image information color separation means searches for one of the candidate values of estimated output halftone ratio that can minimize the difference between the estimated L*a*b* values and the measured L*a*b* values for each of the primary colors, and sets the searched estimated output halftone ratio as the estimated output halftone ratio of each of the primary colors.

In one example, the image information color separation means sets a target halftone ratio value of each of the primary colors based on the input image information. When the estimated output halftone ratio is less than the target halftone ratio, the image information color separation means causes the control means to correct an image forming condition such that a developing density increases when compared with a developing density under which the multi-color toner image that is measured is formed. When the estimated output halftone ratio is greater than the target halftone ratio, the image information color separation means causes the control means to correct an image forming condition such that a developing density decreases when compared with the developing density under which the multi-color toner image that is measured is formed.

In one example, the image forming apparatus further includes color measurement area determining means for determining a color measurement area subjected for measurement by the output image measuring means from an image area of the output image. For example, the color measurement area determining means searches for an area that is most suitable for color measurement based on the input color information to determine the color measurement area.

In one example, the image forming means includes at least latent-image writing means for writing a latent image on the latent image carrier, and developing means for developing the latent image carried by the latent image carrier with toner. The latent-image writing means optically writes a surface of the latent image carrier that is uniformly charged to form the latent image thereon. The developing means applies a developing bias to a developer carrier that carries a developer on the surface thereof to transfer the toner in the developer carried by the developer carrier to the latent image formed on the latent image carrier. The image forming condition corrected by the image forming condition control means includes at least one of a charging intensity of the charging means, an optical writing intensity of the latent image writing means, the developing bias, and a density of the toner in the developer.

The developing means develops the latent image using the developer including toner and carrier particles. The image forming apparatus further includes toner supplying means for supplying toner into the developing means, based on the difference between a detection result of detecting the toner density in the developer contained in the developing means, and a predetermined target toner density.

As described above, the image forming condition control means corrects an image forming condition of each of primary color toner images, based on primary color information that is estimated by the image information color separating means. The target primary color information is set for each one of the primary colors. In this manner, the primary color information estimated based on the measurement result is compared with the target primary color information. The target primary color information may be obtained as color information regarding the primary color toner image used for forming the primary color toner image based on the input image data, or color information regarding the primary color that is estimated based on the measurement result when the output image with the desired image density, or developing density, is obtained. Since comparison is based on the same primary color, analysis can be easily made based on information whether the estimated output primary color is lighter or darker than the target primary color. For each of the primary colors, when the estimated output primary color is lighter than the target primary color, the image forming condition is controlled such that a developing density increases. When the estimated output primary color is darker than the target primary color, the image forming condition is controlled such that a developing density decreases. As long as information is provided, which indicates how the control parameters of image forming condition can be corrected so as to make the difference between the estimated output primary color and the target primary color to be minimum, the image forming condition can be easily corrected with improved accuracy. Since requirements for control parameter information regarding the control parameters of image forming condition are lowered, the color stabilization process can be effectively performed with improved accuracy, while requiring less amount of control parameter information or requiring less amount of time for preparing control parameter information.

In one example, the present invention may reside in an image forming apparatus including: image forming means for forming a plurality of primary color toner images with toner of a plurality of primary colors on a latent image carrier based on input image information; transferring means for transferring the plurality of primary color toner images, directly or indirectly, from the latent image carrier to a recording sheet one above the other to form a multi-color toner image on the recording sheet; measuring means for measuring multi-colors of the multi-color toner image formed on the recording sheet to obtain multi-color information indicating the measured colors of the multi-color toner image; color separation means for estimating primary color information of each one of the primary color toner images that constitute the multi-color toner image, based on the multi-color information obtained by the measuring means, to obtain estimated primary color information indicating estimated colors of the primary color toner images in the multi-color toner image formed on the recording sheet; and image forming condition control means for correcting parameters of the image forming means that affect an image forming condition of each of the plurality of primary color toner images, based on the estimated primary color information.

In one example, the estimated primary color information indicates an estimated output halftone ratio of each one of the primary color toner images that constitute the multi-color toner image formed on the recording sheet.

The image forming apparatus further includes storage means for storing, for each of the plurality of primary colors, association information indicating association between a plurality of spectral reflectance distributions and a plurality of halftone ratios. The color separation means is further configured to: generate, for each one of the plurality of primary color toner images, a plurality of candidate values of the estimated output halftone ratio of the primary color toner image based on the input image information; generate, for each one of the plurality of primary color toner images, an estimated spectral reflectance distribution that corresponds to each one of the plurality of candidate values of estimated output halftone ratio, using the association information stored in the storage means; select, for each one of the plurality of primary color toner images, one of the plurality of candidate values of estimated output halftone ratio that can minimize a difference between the estimated primary color information obtained based on the estimated spectral reflectance distributions of the primary color toner images that constitute the multi-color toner image, and the multi-color information of the multi-color toner image obtained by measuring means; and define, for each one of the plurality of primary color toner images, the selected one of the plurality of candidate values of estimated output halftone ratio that can minimize the difference, to be the estimated output halftone ratio. The storage means may be implemented by any desired storage device such as the ROM 503.

In one example, the multi-color information obtained by the measuring means, such as the spectrometer 900, is a spectral reflectance distribution of the multi-color toner image, and the difference between the estimated primary color information and the multi-color information is a difference between a product of the estimated spectral reflectance distributions of the primary color toner images that constitute the multi-color toner image, and the spectral reflectance distribution of the multi-color toner image.

In one example, the multi-color information obtained by the measuring means, such as the control scanner 800, is a RGB value of the multi-color toner image, and the difference between the estimated primary color information and the multi-color information is a difference between a L*a*b* value converted from a product of the estimated spectral reflectance distributions of the primary color toner images that constitute the multi-color toner image, and a L*a*b* value converted from the RGB value of the multi-color toner image.

In one example, the color separation means sets, for each of the plurality of primary color toner images, a target halftone ratio based on the input image information. When the estimated output halftone ratio is less than the target halftone ratio, the image forming condition control means corrects the parameters of the image forming means so as to increase a developing density. When the estimated output halftone ratio is greater than the target halftone ratio, the control means corrects the parameters of the image forming means so as to decrease a developing density.

In one example, the image forming apparatus further includes measurement area determining means for searching for a color measurement area that is suitable for measurement by the measuring means based on the input color information to determine a color measurement area in the multi-color toner image. The measurement area determining means is implemented by the main controller 500.

In one example, the image forming means includes: latent-image writing means, such as the latent-image writing unit 21, for optically writing a surface of the latent image carrier being charged by charging means, such as the charging device 60, to form a plurality of latent images on the surface of the latent image carrier; and developing means, such as the developing device 61, for developing the plurality of latent images formed on the latent image carrier with toner, by applying a developing bias to a developer carried by a developer carrier, such as the developing sleeve 65, to cause toner in the developer to be transferred from the developer to the latent image formed on the latent image carrier. The parameter of the image forming means includes at least one of: a charging intensity of the charging means; an optical writing intensity of the latent image writing means; the developing bias of the developing means; and a density of toner in the developer contained in the developing means.

The image forming apparatus further includes: detecting means, such as the toner density sensor 71, for detecting the density of toner in the developer contained in the developing means to output a detection result; and supplying means, such as the toner supply port 61*a*, for supplying toner into the developing means, based on a difference between the detection result of the detecting means and a target toner density.

What is claimed is:

1. An image forming apparatus, comprising:

an image forming device configured to form a plurality of primary color toner images with toner of a plurality of primary colors on a latent image carrier based on input image information, and transfer the plurality of primary color toner images, directly or indirectly, from the latent image carrier to a recording sheet one above the other to form a multi-color toner image on the recording sheet;

a measuring device configured to measure multi-colors of the multi-color toner image formed on the recording sheet to obtain multi-color information indicating the measured colors of the multi-color toner image; and a controller configured to:

estimate primary color information of each one of the primary color toner images that constitute the multi-color toner image, based on the multi-color information obtained by the measuring device, to obtain estimated primary color information indicating estimated colors of the primary color toner images in the multi-color toner image formed on the recording sheet, the estimated primary color information indicating an estimated output halftone ratio of each one of the primary color toner images that constitute the multi-color toner image formed on the recording sheet, and correct parameters of the image forming device that affect an image forming condition of each of the plurality of primary color toner images, based on the estimated primary color information;

a storage device configured to store, for each of the plurality of primary colors, association information indicating association between a plurality of halftone ratios and a plurality of spectral reflectance distributions each obtained from a primary color toner image formed with the corresponding halftone ratio, wherein the controller is further configured to:

generate, for each one of the plurality of primary color toner images, a plurality of candidate values of the estimated output halftone ratio of the primary color toner image based on the input image information, generate, for each one of the plurality of primary color toner images, an estimated spectral reflectance distribution that corresponds to each one of the plurality of candidate values of estimated output halftone ratio, using the association information stored in the storage device, select, for each one of the plurality of primary color toner images, one of the plurality of candidate values of estimated output halftone ratio that can minimize a difference between the estimated primary color information obtained based on the estimated spectral reflectance distributions of the primary color toner images that constitute the multi-color toner image, and the multi-color information of the multi-color toner image obtained by the measuring device, and define, for each one of the plurality of primary color toner images, the selected one of the plurality of candidate values of estimated output halftone ratio that can minimize the difference, to be the estimated output halftone ratio.

2. The image forming apparatus of claim 1, wherein:

the multi-color information obtained by the measuring device is a spectral reflectance distribution of the multi-color toner image, and the difference between the estimated primary color information and the multi-color information is a difference between a product of the estimated spectral reflectance distributions of the primary color toner images that constitute the multi-color toner image, and the spectral reflectance distribution of the multi-color toner image.

3. The image forming apparatus of claim 1, wherein:

the multi-color information obtained by the measuring device is a RGB value of the multi-color toner image, and the difference between the estimated primary color information and the multi-color information is a difference between a L*a*b* value converted from a product of the estimated spectral reflectance distributions of the primary color toner images that constitute the multi-color toner image, and a L*a*b* value converted from the RGB value of the multi-color toner image.

4. The image forming apparatus of claim 1, wherein the controller is further configured to:

set, for each of the plurality of primary color toner images, a target halftone ratio based on the input image information; and compare between the estimated output halftone ratio and the target halftone ratio to generate a comparison result, when the comparison result indicates that the estimated output halftone ratio is less than the target halftone ratio, the controller corrects the parameters of the image forming device so as to increase a developing density, and when the comparison result indicates that the estimated output halftone ratio is greater than the target halftone ratio, the controller corrects the parameters of the image forming device so as to decrease a developing density.

5. The image forming apparatus of claim 1, wherein the controller is further configured to search for a color measurement area that is suitable for measurement by the measuring device based on the input color information to determine a color measurement area in the multi-color toner image.

6. The image forming apparatus of claim 1, wherein the image forming device includes:

a latent-image writing unit to optically write a surface of the latent image carrier being charged by a charging device to form a plurality of latent images on the surface of the latent image carrier; and a developing device to develop the plurality of latent images formed on the latent image carrier with toner of the plurality of primary colors, by applying a developing bias to a developer carried by a developer carrier to cause toner in the developer to be transferred from the developer to the latent image formed on the latent image carrier, wherein the parameter of the image forming device includes at least one of: a charging intensity of the charging device; an optical writing intensity of the latent image writing unit; the developing bias of the developing device; and a density of toner in the developer contained in the developing device.

7. The image forming apparatus of claim 6, further comprising:

a toner density detector to detect a density of toner in the developer contained in the developing device to output a detection result; and a toner supplying device to supply toner into the developing device, based on a difference between the detection result of the toner density detector and a target toner density.

8. A method of controlling an image forming apparatus, the method comprising:

forming a plurality of primary color toner images with toner of a plurality of primary colors on a latent image carrier based on input image information;

transferring the plurality of primary color toner images, directly or indirectly, from the latent image carrier to a recording sheet one above the other to form a multi-color toner image on the recording sheet;

measuring multi-colors of the multi-color toner image formed on the recording sheet to obtain multi-color information indicating the measured colors of the multi-color toner image;

estimating primary color information of each one of the primary color toner images that constitute the multi-color toner image, based on the multi-color information to obtain estimated primary color information indicating estimated colors of the primary color toner images in the multi-color toner image formed on the recording sheet;

correcting parameters of the image forming apparatus that affect an image forming condition of each of the plurality of primary color toner images, based on the estimated primary color information;

storing in a memory association information indicating association between a plurality of halftone ratios and a plurality of spectral reflectance distributions each obtained from a primary color toner image formed with the corresponding halftone ratio, for each of the plurality of primary colors;

generating, for each one of the plurality of primary color toner images, a plurality of candidate values of the estimated output halftone ratio of each one of the primary color toner images that constitute the multi-color toner image formed on the recording sheet based on the input image information, the estimated output halftone ratio being used as the estimated primary color information;

generating, for each one of the plurality of primary color toner images, an estimated spectral reflectance distribution that corresponds to each one of the plurality of candidate values of estimated output halftone ratio, using the association information stored in the memory;

selecting, for each one of the plurality of primary color toner images, one of the plurality of candidate values of estimated output halftone ratio that can minimize a difference between the estimated primary color information obtained based on the estimated spectral reflectance distributions of the primary color toner images that constitute the multi-color toner image, and the multi-color information of the multi-color toner image; and defining, for each one of the plurality of primary color toner images, the selected one of the plurality of candidate values of estimated output halftone ratio that can minimize the difference, to be the estimated output halftone ratio.

9. The method of claim 8, further comprising:

setting, for each of the plurality of primary color toner images, a target halftone ratio based on the input image information;

comparing between the estimated output halftone ratio and the target halftone ratio to generate a comparison result; and correcting the parameters of the image forming apparatus so as to increase or decrease a developing density based on the comparison result, wherein when the comparison result indicates that the estimated output halftone ratio is less than the target halftone ratio, the parameters of the image forming apparatus are corrected so as to increase the developing density, and when the comparison result indicates that the estimated output halftone ratio is greater than the target halftone ratio, the parameters of the image forming apparatus are corrected so as to decrease the developing density.

10. The method of claim 8, further comprising:

searching for a color measurement area that is suitable for measurement based on the input color information to determine a color measurement area in the multi-color toner image, the multi-color information being obtained from the color measurement area in the multi-color toner image.

11. The method of claim 8, further comprising:

detecting a density of toner in a developer contained in a developing device to output a detection result; and supplying toner into the developing device, based on a difference between the detection result and a target toner density.

12. A non-transitory recording medium storing a plurality of instructions which, when executed by a processor, cause the processor to perform a method of controlling an image forming apparatus, the method comprising:

forming a plurality of primary color toner images with toner of a plurality of primary colors on a latent image carrier based on input image information;

transferring the plurality of primary color toner images, directly or indirectly, from the latent image carrier to a recording sheet one above the other to form a multi-color toner image on the recording sheet;

measuring multi-colors of the multi-color toner image formed on the recording sheet to obtain multi-color information indicating the measured colors of the multi-color toner image;

estimating primary color information of each one of the primary color toner images that constitute the multi-color toner image, based on the multi-color information to obtain estimated primary color information indicating estimated colors of the primary color toner images in the multi-color toner image formed on the recording sheet;

correcting parameters of the image forming apparatus that affect an image forming condition of each of the plurality of primary color toner images, based on the estimated primary color information;

storing in a memory association information indicating association between a plurality of halftone ratios and a plurality of spectral reflectance distributions each obtained from a primary color toner image formed with the corresponding halftone ratio, for each of the plurality of primary colors;

generating, for each one of the plurality of primary color toner images, a plurality of candidate values of the estimated output halftone ratio of each one of the primary color toner images that constitute the multi-color toner image formed on the recording sheet based on the input image information, the estimated output halftone ratio being used as the estimated primary color information;

generating, for each one of the plurality of primary color toner images, an estimated spectral reflectance distribution that corresponds to each one of the plurality of candidate values of estimated output halftone ratio, using the association information stored in the memory;

selecting, for each one of the plurality of primary color toner images, one of the plurality of candidate values of estimated output halftone ratio that can minimize a difference between the estimated primary color information obtained based on the estimated spectral reflectance distributions of the primary color toner images that constitute the multi-color toner image, and the multi-color information of the multi-color toner image; and defining, for each one of the plurality of primary color toner images, the selected one of the plurality of candidate values of estimated output halftone ratio that can minimize the difference, to be the estimated output halftone ratio.

13. The method of claim 12, further comprising:

setting, for each of the plurality of primary color toner images, a target halftone ratio based on the input image information;

comparing between the estimated output halftone ratio and the target halftone ratio to generate a comparison result; and correcting the parameters of the image forming apparatus so as to increase or decrease a developing density based on the comparison result, wherein when the comparison result indicates that the estimated output halftone ratio is less than the target halftone ratio, the parameters of the image forming apparatus are corrected so as to increase the developing density, and when the comparison result indicates that the estimated output halftone ratio is greater than the target halftone ratio, the parameters of the image forming apparatus are corrected so as to decrease the developing density.

14. The method of claim 12, further comprising:

searching for a color measurement area that is suitable for measurement based on the input color information to determine a color measurement area in the multi-color toner image, the multi-color information being obtained from the color measurement area in the multi-color toner image.

15. The method of claim 12, further comprising:

detecting a density of toner in a developer contained in a developing device to output a detection result; and supplying toner into the developing device, based on a difference between the detection result and a target toner density.

* * * * *